US010359207B2

(12) United States Patent
Motomura et al.

(10) Patent No.: US 10,359,207 B2
(45) Date of Patent: Jul. 23, 2019

(54) AIR-CONDITIONING APPARATUS

(71) Applicants: Yuji Motomura, Tokyo (JP); Daisuke Shimamoto, Tokyo (JP); Takayoshi Honda, Tokyo (JP); Osamu Morimoto, Tokyo (JP); Koji Nishioka, Tokyo (JP); Tatsuo Ono, Tokyo (JP)

(72) Inventors: Yuji Motomura, Tokyo (JP); Daisuke Shimamoto, Tokyo (JP); Takayoshi Honda, Tokyo (JP); Osamu Morimoto, Tokyo (JP); Koji Nishioka, Tokyo (JP); Tatsuo Ono, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 340 days.

(21) Appl. No.: 14/441,232

(22) PCT Filed: Nov. 30, 2012

(86) PCT No.: PCT/JP2012/081072

§ 371 (c)(1),
(2) Date: May 7, 2015

(87) PCT Pub. No.: WO2014/083681

PCT Pub. Date: Jun. 5, 2014

(65) Prior Publication Data

US 2015/0300676 A1 Oct. 22, 2015

(51) Int. Cl.
*F24F 11/48* (2018.01)
*F25B 7/00* (2006.01)
(Continued)

(52) U.S. Cl.
CPC ..... *F24F 11/76* (2018.01); *F24F 3/06* (2013.01); *F24F 11/30* (2018.01); *F24F 11/48* (2018.01);
(Continued)

(58) Field of Classification Search
CPC .... F25B 7/00; F25B 2600/01; F25B 2600/11; F25B 2600/111; F25B 2600/112;
(Continued)

(56) References Cited

U.S. PATENT DOCUMENTS 4,770,000 A * 9/1988 Kuroda ..... F25B 13/00 62/156
5,561,363 A * 10/1996 Mashino ..... H02J 1/14 322/25

(Continued)

FOREIGN PATENT DOCUMENTS

CN 102378880 A 3/2012
EP 2 341 295 A1 7/2011

(Continued)

OTHER PUBLICATIONS

Extended European Search Report dated Jul. 8, 2016 issued in corresponding EP patent application No. 12888999.5.

(Continued)

*Primary Examiner* — Edward F Landrum
*Assistant Examiner* — Daniel C Comings
(74) *Attorney, Agent, or Firm* — Posz Law Group, PLC

(57) ABSTRACT

When starting a cooling operation mode from a non-operating mode, the blower device of the indoor unit from which the start command is originated is operated. When starting a heating operation mode from a non-operating mode, the blower device of the indoor unit from which the start command is originated is operated after the heat medium temperature becomes equal to or greater than a preconfigured temperature.

6 Claims, 7 Drawing Sheets

(51) Int. Cl.

| | |
|---|---|
| ***F25B 30/00*** | (2006.01) |
| ***F24F 11/76*** | (2018.01) |
| ***F25B 13/00*** | (2006.01) |
| ***F25B 25/00*** | (2006.01) |
| ***F24F 3/06*** | (2006.01) |
| ***F25B 49/02*** | (2006.01) |
| ***F25B 1/00*** | (2006.01) |
| ***F25D 17/02*** | (2006.01) |
| ***F24F 11/30*** | (2018.01) |
| ***F24F 11/62*** | (2018.01) |
| *F24F 110/10* | (2018.01) |
| *F24F 140/20* | (2018.01) |
| *F24F 11/65* | (2018.01) |

(52) U.S. Cl.

CPC ..... *F24F 11/62* (2018.01); *F25B 1/00* (2013.01); *F25B 13/00* (2013.01); *F25B 25/005* (2013.01); *F25B 49/02* (2013.01); *F25D 17/02* (2013.01); *F24F 11/65* (2018.01); *F24F 2110/10* (2018.01); *F24F 2140/20* (2018.01); *F24F 2221/54* (2013.01); *F25B 7/00* (2013.01); *F25B 30/00* (2013.01); *F25B 2313/006* (2013.01); *F25B 2313/0231* (2013.01); *F25B 2313/0272* (2013.01); *F25B 2313/0293* (2013.01); *F25B 2313/02743* (2013.01); *F25B 2600/01* (2013.01); *F25B 2600/11* (2013.01); *F25B 2600/23* (2013.01)

(58) Field of Classification Search

CPC ..... F25B 2600/23; F25B 30/00; F24F 11/48; F24F 11/56; F24F 2221/38; F24F 2221/54

See application file for complete search history.

(56) References Cited

U.S. PATENT DOCUMENTS

| | | | | |
|---|---|---|---|---|
| 5,934,087 | A * | 8/1999 | Watanabe | F25B 49/005 62/126 |
| 2005/0115258 | A1 * | 6/2005 | Violand | F24F 1/027 62/186 |
| 2005/0268628 | A1 | 12/2005 | Thompson | |
| 2011/0185754 | A1 * | 8/2011 | Yamashita | F24F 3/06 62/132 |
| 2012/0006050 | A1 | 1/2012 | Takayama et al. | |
| 2012/0131948 | A1 * | 5/2012 | Yamashita | F24F 3/06 62/513 |

FOREIGN PATENT DOCUMENTS

| | | | | |
|---|---|---|---|---|
| JP | S58-006350 | A | 1/1983 | |
| JP | 03221747 | A * | 9/1991 | |
| JP | H05-280818 | A | 10/1993 | |
| JP | 2001-289465 | A | 10/2001 | |
| JP | 2003-343936 | A | 12/2003 | |
| JP | 2005-140444 | A | 6/2005 | |
| JP | WO 2011030418 | A1 * | 3/2011 | F24F 3/06 |
| JP | 2011-105150 | A | 6/2011 | |
| JP | 2012-011931 | A | 1/2012 | |
| WO | 2010/049998 | A1 | 5/2010 | |
| WO | 2011/030418 | A1 | 3/2011 | |

OTHER PUBLICATIONS

International Search Report of the International Searching Authority dated Feb. 19, 2013 for the corresponding international application No. PCT/JP2012/081072 (and English translation).

Office Action dated Jan. 12, 2016 in the corresponding JP application No. 2014-549728 (with English translation).

Chinese Office Action dated Nov. 2, 2016 in the corresponding CN application No. 201280077259.5(English translation attached).

* cited by examiner

F I G. 6

(a)

[COOLING OPERATION MODE AFTER NON- OPERATION]

| INDOOR UNIT 3 | BLOWER DEVICE | OFF | START OF AIR CONDITIONING BY BLOWER DEVICE OPERATION | PRECONFIGURED FLOW RATE |
|---|---|---|---|---|
| OPERATING STATE OF RELAY UNIT 2 | | NON-OPERATION | COOLING ACTIVATION MODE (PERFORM CONTROL OF ACTUATORS INSIDE RELAY UNIT 2) | COOLING OPERATION |
| OPERATING STATE OF INDOOR UNIT 3 | | NON-OPERATION | COOLING ACTIVATION MODE (PERFORM CONTROL OF ACTUATORS INSIDE RELAY UNIT 2) | COOLING OPERATION |

(b)

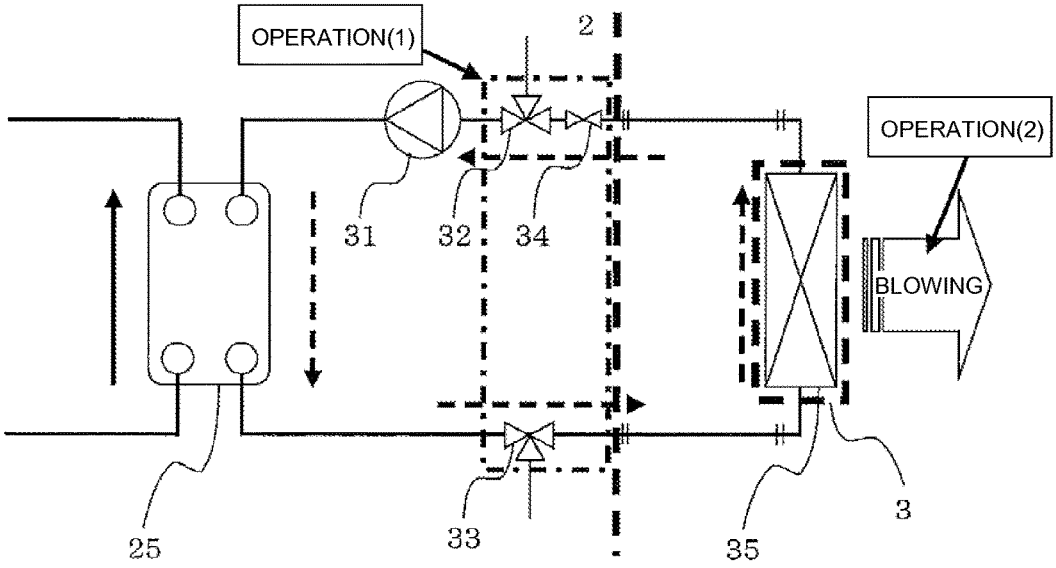

F I G. 7

(a)

[HEATING OPERATION MODE AFTER NON-OPERATION]

| | | | | |
|---|---|---|---|---|
| INDOOR UNIT 3 | BLOWER DEVICE | PERFORM HEAT MEDIUM TEMPERATURE RAISING OPERATION WITH AIR BLOWING STOPPED<br>OFF | VERY LOW | PRECONFIGURED FLOW RATE<br>LOW |
| OPERATING STATE OF RELAY UNIT 2 | | NON-OPERATION | HEATING ACTIVATION MODE (PERFORM CONTROL OF ACTUATORS INSIDE RELAY UNIT 2) | HEATING OPERATION |
| OPERATING STATE OF INDOOR UNIT 3 | | NON-OPERATION | HEATING ACTIVATION MODE (PERFORM CONTROL OF ACTUATORS INSIDE RELAY UNIT 2) | HEATING OPERATION |

(b)

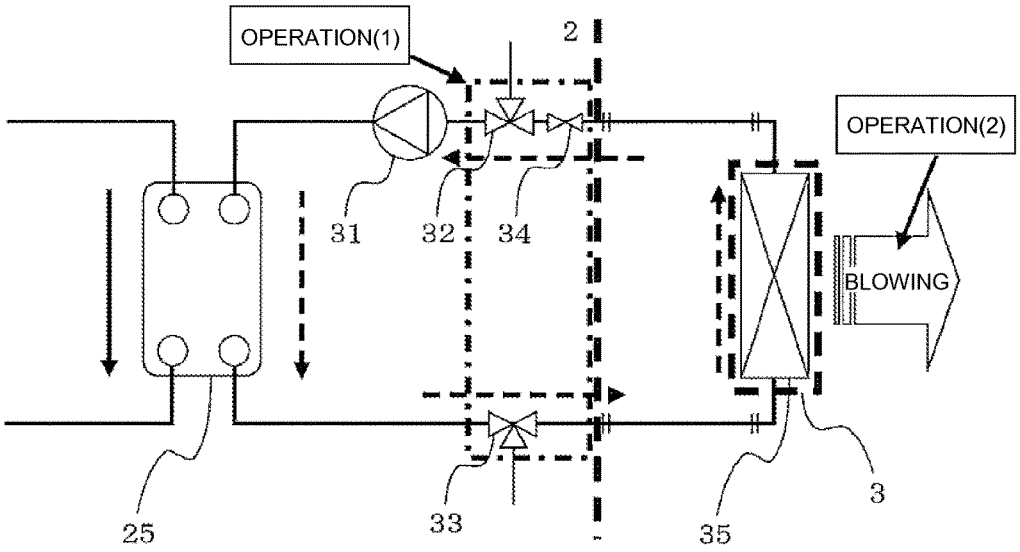

AIR-CONDITIONING APPARATUS

CROSS REFERENCE TO RELATED APPLICATION

This application is a U.S. national stage application of International Application No. PCT/JP2012/081072 filed on Nov. 30, 2012, the disclosure of which is incorporated by reference.

TECHNICAL FIELD

The present invention relates to an air-conditioning apparatus applied to a multi-air conditioning system for a building, for example.

BACKGROUND ART

Heretofore, in an air-conditioning apparatus such as a multi-air conditioning system for a building, refrigerant is circulated between an outdoor unit, which is a heat source device installed on the outside of the building, and indoor units installed inside the rooms of the building, for example. The refrigerant removes or gives off heat, and an air-conditioned space is cooled or heated using air that has been cooled or heated. A refrigerant such as a hydrofluorocarbon (HFC)-based refrigerant is often used as the refrigerant in such an air-conditioning apparatus. In addition, the use of natural refrigerants such as carbon dioxide ($CO_2$) is also proposed.

Also, in an air-conditioning apparatus called a chiller, cooling energy or heating energy is generated in the heat source device installed on the outside of the building. Subsequently, a substance such as water or antifreeze is heated or cooled by a heat exchanger installed inside the outdoor unit, and the heated or cooled substance is then transported to an indoor unit such as a fan coil unit or panel heater to conduct cooling or heating (see Patent Literature 1, for example).

Also, there is a device called a waste heat absorption chiller in which four water pipes are connected between the heat source device and an indoor unit, and cooled and heated water or the like is supplied at the same time, thereby enabling cooling or heating to be freely selected at the indoor unit (see Patent Literature 2, for example).

Also, there is a configuration in which heat exchangers for a primary refrigerant and a secondary refrigerant are installed near each indoor unit, so that secondary refrigerant is transported to the indoor unit (see Patent Literature 3, for example).

Also, there is a configuration in which an outdoor device and a branching unit equipped with a heat exchanger are connected with two pipes, so that secondary refrigerant is transported to the indoor unit (see Patent Literature 4, for example).

Also, among air-conditioning apparatuss such as multi-air conditioning systems for a building, there exists an air-conditioning apparatus that circulates refrigerant from an outdoor unit to a relay unit, and circulates a heat medium such as water from the relay unit to indoor units, thereby reducing the transport power for a heat medium such as water while circulating the heat medium through indoor units (see Patent Literature 5, for example).

CITATION LIST

Patent Literature

Patent Literature 1: Japanese Unexamined Patent Application Publication No. 2005-140444 (such as pg. 4, FIG. 1)

Patent Literature 2: Japanese Unexamined Patent Application Publication No. 5-280818 (such as pgs. 4-5, FIG. 1)

Patent Literature 3: Japanese Unexamined Patent Application Publication No. 2001-289465 (such as pgs. 5-8, FIGS. 1-2)

Patent Literature 4: Japanese Unexamined Patent Application Publication No. 2003-343936 (such as pg. 5, FIG. 1)

Patent Literature 5: International Publication Pamphlet No. WO10/049998 (such as pg. 3, FIG. 1)

SUMMARY OF INVENTION

Technical Problem

In an air-conditioning apparatus such as a multi-air conditioning system for a building of the related art, since refrigerant is circulated to the indoor units, there is a possibility of the refrigerant leaking into a room or the like. On the other hand, with an air-conditioning apparatus as described in Patent Literature 1 and Patent Literature 2, the refrigerant does not pass through the indoor units. However, with an air-conditioning apparatus as described in Patent Literature 1 and Patent Literature 2, heat medium is heated or cooled in the heat source device on the outside of the building, and must be transported to the indoor unit side. For this reason, the circulation path of the heat medium becomes longer. In this case, if one attempts to use heat medium to transport heat that performs the job of designated heating or cooling, the amount of energy consumed by the transport power and the like becomes higher than that of the refrigerant. For this reason, if the circulation path becomes longer, the transport power becomes extremely large. Given this issue, energy savings may be achieved in an air-conditioning apparatus if the circulation of heat medium could be successfully controlled.

With an air-conditioning apparatus as described in Patent Literature 2, four pipes must be connected from the outdoor side to the indoors to enable the selection of cooling or heating for each indoor unit, resulting in poor practicality of construction. The air-conditioning apparatus described in Patent Literature 3 requires each individual indoor unit to be equipped with a secondary air-conditioning apparatus circulating means such as a pump, resulting in not only an expensive system, but also a large amount of noise, and thus is impractical. Moreover, since the heat exchangers exist near the indoor units, there is a possibility of refrigerant leaking into a location near a room.

With an air-conditioning apparatus as described in Patent Literature 4, the primary refrigerant after heat exchange flows through the same channel as the primary refrigerant before heat exchange, and thus when connecting to multiple indoor units, maximum performance is not achieved at each indoor unit, resulting in an energy-wasting configuration. Also, the connection between a branching unit and extension pipes is made with two for cooling and two for heating, for a total of four pipes, resulting in a configuration similar to the system in which the outdoor device and the branching unit are connected by four pipes, and also resulting in a system with poor practicality of construction.

An air-conditioning apparatus as described in Patent Literature 5 is not problematic when using a single refrigerant or a near-azeotropic refrigerant, but in the case of using a non-azeotropic refrigerant mixture, when using a refrigerant/heat medium intermediate heat exchanger as an evaporator, the heat medium may freeze due to the temperature glide between the saturated liquid temperature and the saturated gas temperature of the refrigerant, and there is a possibility of reduced heat-exchanging performance between the refrigerant and the heat medium.

Also, in an air-conditioning apparatus such as a multi-air conditioning system for a building of the related art, since refrigerant is circulated to indoor devices, when attempting to perform cooling operation or heating operation from a state in which the connected indoor device is stopped, refrigerant may exist in the stopped indoor device or in a connected pipe in some cases. In this case, there may be an insufficient amount of refrigerant on the outdoor device side and circulating refrigerant may become more difficult, which causes a corresponding increase in the time required to generate the refrigerant of preset temperature for the heating operation or cooling operation. As a result, there is a longer time between when the user performs a user operation for conducting cooling operation or heating operation, and when air at the preset temperature is supplied from the indoor device, and thus there is a possibility of degraded user comfort.

The present invention has been devised to solve problems like the above, and an objective thereof is to provide an air-conditioning apparatus that shortens the wait time until the activation of cooling operation and the activation of heating operation without degrading user comfort.

Solution to Problem

An air-conditioning apparatus according to the present invention is provided with: a refrigerant circuit that circulates heat source side refrigerant through a compressor, a heat source side heat exchanger, a plurality of expansion devices, and refrigerant-side flow channels of a plurality of intermediate heat exchangers, which are connected by refrigerant pipes; a heat medium circuit that circulates heat medium through a pump, a plurality of use side heat exchangers, and heat medium-side flow channels of the plurality of intermediate heat exchangers, which are connected by heat medium transport pipes; and a blower device corresponding to each of the use side heat exchangers. The air-conditioning apparatus exchanges heat between the heat source side refrigerant and the heat medium in the intermediate heat exchangers, and includes a cooling operation mode in which at least one of the plurality of use side heat exchangers performs cooling operation using heat medium cooled by the intermediate heat exchangers, a heating operation mode in which at least one of the plurality of use side heat exchangers performs heating operation using heat medium heated by the intermediate heat exchangers, and a non-operating mode in which the compressor, the pump, each of the use side heat exchangers, and each of the blower devices are stopped. When starting the cooling operation mode from the non-operating mode, the blower device of the indoor unit from which a start command is originated is operated. When starting the heating operation mode from the non-operating mode, the blower device of the indoor unit from which a start command is originated is operated after the temperature of the heat medium becomes equal to or greater than a preconfigured temperature.

Advantageous Effects of Invention

An air-conditioning apparatus according to the present invention includes the above configuration, and thus is able to shorten the wait time until the activation of cooling operation and the activation of heating operation without degrading user comfort.

BRIEF DESCRIPTION OF DRAWINGS

FIG. 6 is a diagram explaining the operating status in a case in which any indoor unit starts cooling operation from a non-operating mode.

FIG. 7 is an explanatory diagram for a case in which any indoor unit starts heating operation from a non-operating mode.

DESCRIPTION OF EMBODIMENT

Hereinafter, the Embodiment of the present invention will be described on the basis of the drawings.

Figure 1:
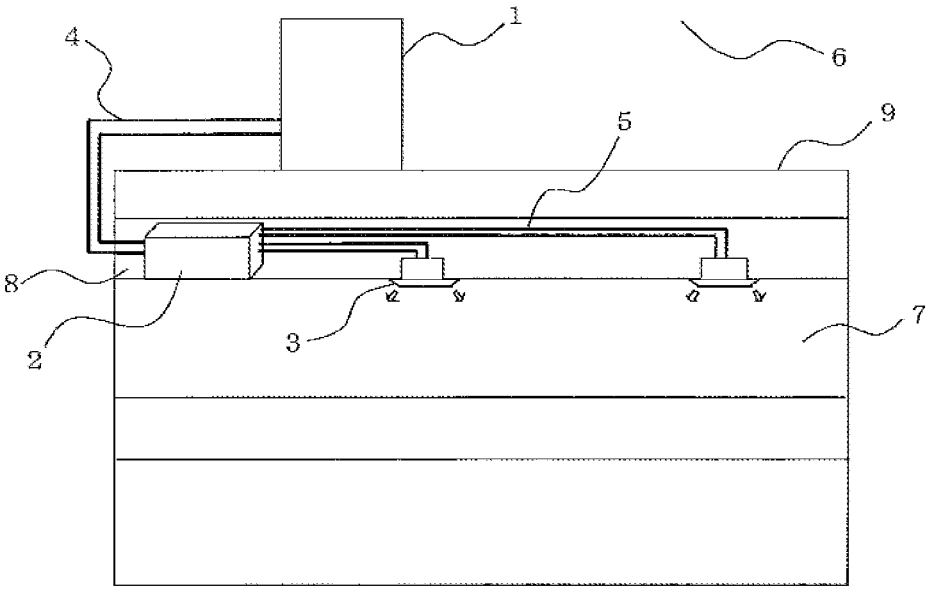
FIG. 1 is a schematic diagram illustrating an exemplary installation of an air-conditioning apparatus according to the Embodiment of the present invention.

FIG. 1 is a diagram illustrating an exemplary installation of an air-conditioning apparatus according to the Embodiment of the present invention. An exemplary installation of the air-conditioning apparatus will be described on the basis of FIG. 1. The present air-conditioning apparatus is configured so that each indoor unit is able to freely select a cooling mode or a heating mode as the operating mode by utilizing refrigeration cycles (a refrigerant circuit A and a heat medium circuit B) that circulate refrigerant (heat source side refrigerant, heat medium). FIG. 1 schematically illustrates an overview of an air-conditioning apparatus in which multiple indoor units 3 are connected. Note that, in the drawings hereinafter, including FIG. 1, the relative sizes of respective structural members may differ from actual sizes in some cases.

In FIG. 1, an air-conditioning apparatus according to the Embodiment is equipped with an outdoor unit (heat source device) 1, multiple indoor units 3, and one relay unit 2 interposed between the outdoor unit 1 and the indoor units 3. The relay unit 2 exchanges heat between heat source side refrigerant and heat medium. The outdoor unit 1 and the relay unit 2 are connected by refrigerant pipes 4 that conduct heat source side refrigerant. The relay unit 2 and the indoor units 3 are connected by pipes (heat medium transport pipes) 5 that conduct heat medium. Also, cooling energy or heating energy generated at the outdoor unit 1 is delivered to the indoor units 3 via the relay unit 2.

The outdoor unit 1 is ordinarily installed in an outdoor space 6, which is a space outside a building or other facility 9 (such as the roof, for example), and provides cooling energy or heating energy to the indoor units 3 via the relay unit 2. The indoor units 3 are disposed at positions able to supply cooled air or heated air to an indoor space 7, which is a space inside the facility 9 (such as a room, for example), and provide cooled air or heated air to the indoor space 7 to be air-conditioned. The relay unit 2 is configured as a separate housing from the outdoor unit 1 and the indoor units 3 that is installable in a separate location from the outdoor space 6 and the indoor space 7, is connected to the outdoor unit 1 and the indoor units 3 by the refrigerant pipes 4 and the pipes 5, respectively, and conveys cooling energy or heating energy supplied from the outdoor unit 1 to the indoor units 3.

Operation of an air-conditioning apparatus according to the Embodiment of the present invention will be briefly described.

Heat source side refrigerant is transported from the outdoor unit 1 to the relay unit 2 via the refrigerant pipes 4. The transported heat source side refrigerant exchanges heat with a heat medium at an intermediate heat exchanger (the intermediate heat exchanger 25 discussed later) inside the relay unit 2, and the heat medium is heated or cooled. In other words, heated water or cooled water is created by the intermediate heat exchanger. The heated water or cooled water created at the relay unit 2 is transported to the indoor units 3 via the pipes 5 by a heat medium transport device (the pump 31 discussed later), and heating operation (which may be any operating state requiring heated water) or cooling operation (which may be any operating state requiring cooled water) is provided to the indoor space 7 by the indoor units 3.

The refrigerant used as the heat source side refrigerant may be, for example, a single refrigerant such as R-22 or R-134a, a near-azeotropic refrigerant mixture such as R-410A or R-404A, a non-azeotropic refrigerant mixture such as R-407C, refrigerants and compounds that include a double bond in the chemical formula and have a comparatively low global warming potential value, such as $CF_3CF{=}CH_2$, or natural refrigerants such as $CO_2$ and propane.

On the other hand, for the heat medium, substances such as water, antifreeze, a mixture of water and antifreeze, or a mixture of water and a highly anticorrosive additive may be used, for example.

As illustrated in FIG. 1, in an air-conditioning apparatus according to the Embodiment, the outdoor unit 1 and the relay unit 2 are connected using two refrigerant pipes 4, while the relay unit 2 and each of the indoor units 3 are connected by two pipes 5. In this way, by using two pipes (the refrigerant pipes 4 and the pipes 5) to connect each unit (the outdoor unit 1, the indoor units 3, and the relay unit 2) in the air-conditioning apparatus according to the Embodiment, construction becomes easy.

Note that FIG. 1 illustrates, as an example, a state in which the relay unit 2, although inside the facility 9, is installed in a space which is a separate space from the indoor space 7, such as above the ceiling (hereinafter simply designated the space 8). Consequently, besides being installed above the ceiling, the relay unit 2 may be installed anywhere insofar as the location is not in a living space and is a space having some kind of ventilation to the outside. For example, it is possible to install the relay unit 2 in a shared space containing an elevator or the like and having ventilation to the outside, for example. In addition, the relay unit 2 may also be installed near the outdoor unit 1. However, the heat medium pumping power will be very large if the distance from the relay unit 2 to the indoor units 3 is too long, and thus care must be taken not to squander the energy-saving advantages.

Although FIG. 1 illustrates the case of the outdoor unit 1 being installed in the outdoor space 6 as an example, the configuration is not limited thereto. For example, the outdoor unit 1 may also be installed in an enclosed space such as a ventilated machine room. The outdoor unit 1 may also be installed inside the facility 9 insofar as waste heat can be exhausted outside the facility 9 by an exhaust duct. Alternatively, the outdoor unit 1 may also be installed inside the facility 9 in the case of using a water-cooled outdoor unit 1. Installing the outdoor unit 1 in such locations is not particularly problematic.

Also, although FIG. 1 illustrates the case in which the indoor units 3 are ceiling cassettes as an example, the configuration is not limited thereto, and the indoor units 3 may be of any type, such as ceiling-concealed or ceiling-hung units, insofar as the indoor units 3 are able to expel heated air or cooled air into the indoor space 7 directly or via means such as ducts.

Furthermore, the number of connected outdoor units 1, indoor units 3, and relay units 2 is not limited to the numbers illustrated in FIG. 1, and it is sufficient to determine numbers according to the facility 9 where the air-conditioning apparatus according to the Embodiment is installed.

In the case of connecting multiple relay units 2 to the outdoor unit 1, the multiple relay units 2 may be installed at distributed points in shared spaces or spaces such as above the ceiling throughout the building or other facility. In so doing, the air conditioning load may be distributed among the intermediate heat exchangers in each of the relay units 2. In addition, it is possible to install the indoor units 3 at a distance or height that is within an allowable transport range of the heat medium transport device in each relay unit 2, enabling installation throughout the entire building or other facility.

Figure 2:
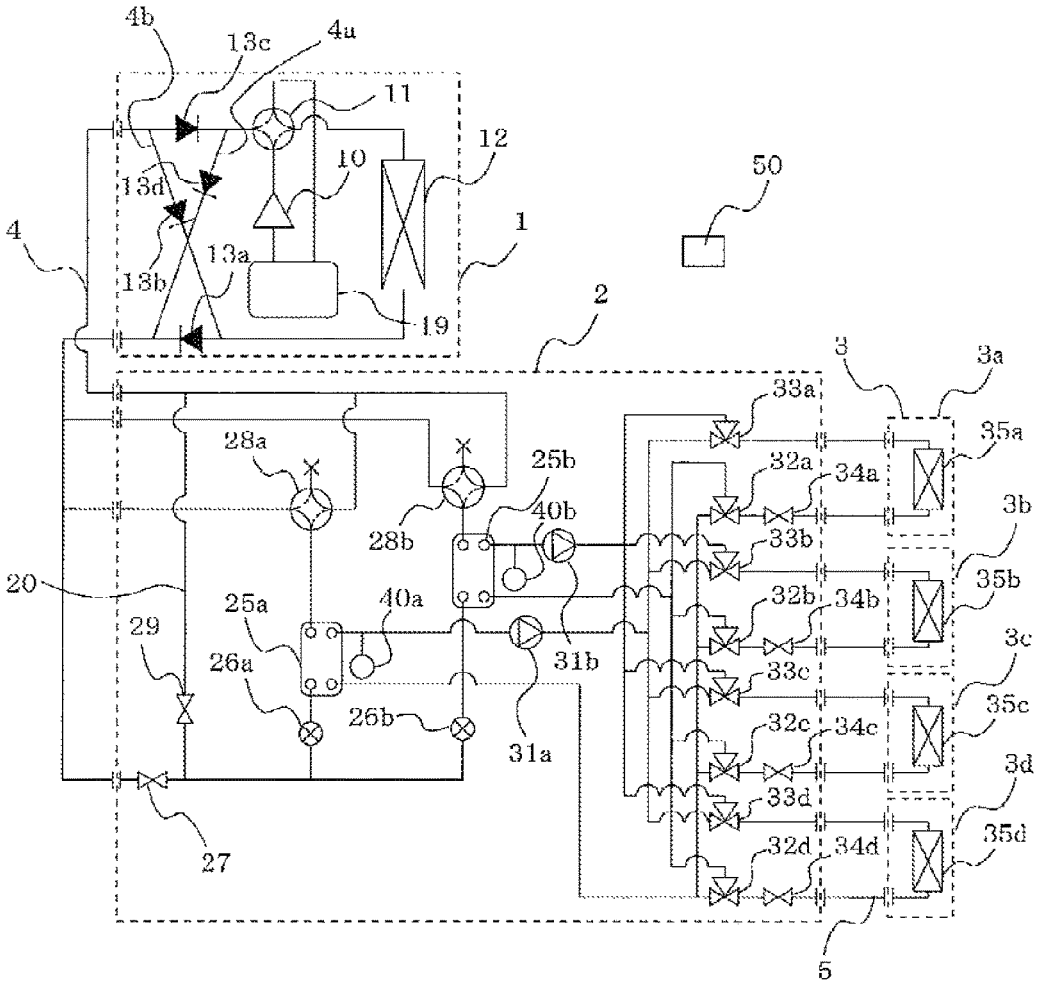
FIG. 2 is a schematic circuit configuration diagram illustrating an example of a circuit configuration of an air-conditioning apparatus according to the Embodiment of the present invention.

FIG. 2 is a schematic circuit configuration diagram illustrating a circuit configuration of an air-conditioning apparatus (hereinafter designated the air-conditioning apparatus 100) according to the Embodiment of the present invention. On the basis of FIG. 2, the configuration of the air-conditioning apparatus 100, or in other words, the action of each actuator constituting the refrigerant circuit, will be described in detail. As illustrated in FIG. 2, the outdoor unit 1 and the relay unit 2 are connected by the refrigerant pipes 4 via an intermediate heat exchanger (refrigerant/water heat exchanger) 25*a* and an intermediate heat exchanger (refrigerant/water heat exchanger) 25*b* provided in the relay unit 2. Also, the relay unit 2 and the indoor units 3 are likewise connected by the pipes 5 via the intermediate heat exchanger 25*a* and the intermediate heat exchanger 25*b*. Note that the refrigerant pipes 4 and the pipes 5 will be further discussed at a later stage.

[Outdoor Unit 1]

The outdoor unit 1 is equipped with a compressor 10, a first refrigerant channel switching device 11 such as a four-way valve, a heat source side heat exchanger 12, and an accumulator 19, which are connected in series by refrigerant pipes 4. The outdoor unit 1 is also provided with a refrigerant connecting pipe 4*a*, a refrigerant connecting pipe 4*b*, a check valve 13*a*, a check valve 13*b*, a check valve 13*c*, and a check valve 13*d*. Providing the refrigerant connecting pipe 4*a*, the refrigerant connecting pipe 4*b*, the first check valve 13*a*, the first check valve 13*b*, the first check valve 13*c*, and the first check valve 13*d* makes it possible to keep the flow of heat source side refrigerant circulating into the relay unit 2 going in a fixed direction, regardless of the operation demanded by the indoor units 3.

The compressor 10 suctions heat source side refrigerant and compresses the heat source side refrigerant to a high temperature, high pressure state for transport along the refrigerant circuit A. The compressor 10 may be configured as a variable-capacity inverter compressor, for example. The first refrigerant channel switching device 11 switches between a flow of heat source side refrigerant during heating operation (during the heating only operating mode and during the heating main operating mode discussed later) and a flow of heat source side refrigerant during cooling operation (during the cooling only operating mode and during the cooling main operating mode discussed later).

The heat source side heat exchanger 12 functions as an evaporator during heating operation, functions as a condenser (or radiator) during cooling operation, and exchanges heat between the heat source side refrigerant and a fluid such as air supplied from a blower device such as a fan (not illustrated), causing that heat source side refrigerant to evaporate and gasify or condense and liquefy. The accumulator 19 is provided on the suction side of the compressor 10 and accumulates surplus refrigerant due to the difference between heating operation and cooling operation, or surplus refrigerant due to transient changes in operation.

The check valve 13*c* is provided on a refrigerant pipe 4 between the relay unit 2 and the first refrigerant channel switching device 11, and allows the flow of heat source side refrigerant only in a designated direction (the direction from the relay unit 2 to the outdoor unit 1). The check valve 13*a* is provided on a refrigerant pipe 4 between the heat source side heat exchanger 12 and the relay unit 2, and allows the flow of heat source side refrigerant only in a designated direction (the direction from the outdoor unit 1 to the relay unit 2). The check valve 13*d* is provided on the refrigerant connecting pipe 4*a*, and causes heat source side refrigerant discharged from the compressor 10 during heating operation to circulate into the relay unit 2. The check valve 13*b* is provided on the refrigerant connecting pipe 4*b*, and causes heat source side refrigerant returning from the relay unit 2 during heating operation to flow to the suction side of the compressor 10.

The refrigerant connecting pipe 4*a* connects, inside the outdoor unit 1, the refrigerant pipe 4 between the first refrigerant channel switching device 11 and the check valve 13*c*, and the refrigerant pipe 4 between the check valve 13*a* and the relay unit 2. The refrigerant connecting pipe 4*b* connects, inside the outdoor unit 1, the refrigerant pipe 4 between the check valve 13*c* and the relay unit 2, and refrigerant pipe 4 between the heat source side heat exchanger 12 and the check valve 13*a*. Note that although FIG. 2 illustrates an example of providing the refrigerant connecting pipe 4*a*, the refrigerant connecting pipe 4*b*, the check valve 13*a*, the check valve 13*b*, the check valve 13*c*, and the check valve 13*d*, the configuration is not limited thereto, and the above components are not required to be provided.

[Indoor Units 3]

The indoor units 3 are respectively equipped with use side heat exchangers 35. The use side heat exchangers 35 are connected to heat medium flow control devices 34 and second heat medium channel switching devices 33 of the relay unit 2 by the pipes 5. The use side heat exchangers 35 exchange heat between heat medium and air supplied from a blower device such as a fan (not illustrated), and generate heated air or cooled air to supply to the indoor space 7.

FIG. 2 illustrates a case in which four indoor units 3 are connected to the relay unit 2 as an example, these being indicated as an indoor unit 3*a*, an indoor unit 3*b*, an indoor unit 3*c*, and an indoor unit 3*d* from the top of the page. Also, the use side heat exchangers 35 are indicated as a use side heat exchanger 35*a*, a use side heat exchanger 35*b*, a use side heat exchanger 35*c*, and a use side heat exchanger 35*d* from the top of the page, in correspondence with the indoor unit 3*a* to the indoor unit 3*d*. Note that, similarly to FIG. 1, the number of connected indoor units 3 is not limited to the four illustrated in FIG. 2.

[Relay Unit 2]

The relay unit 2 is equipped with at least two or more intermediate heat exchangers 25, two expansion devices 26, two opening and closing devices (opening and closing device 27, opening and closing device 29), two second refrigerant channel switching devices 28, two pumps 31, four first heat medium channel switching devices 32, four second heat medium channel switching devices 33, and four heat medium flow control devices 34.

The two intermediate heat exchangers 25 (intermediate heat exchanger 25*a*, intermediate heat exchanger 25*b*) function as condensers (radiators) when supplying heating energy to indoor units 3 performing heating operation, and function as evaporators when supplying cooling energy to indoor units 3 performing cooling operation, exchanging heat between heat source side refrigerant and heat medium, and transferring cooling energy or heating energy generated by the outdoor unit 1 and stored in the heat source side refrigerant to the heat medium. The intermediate heat exchanger 25*a* is provided between the expansion device 26*a* and the second refrigerant channel switching device 28*a* on the refrigerant circuit A, serving to cool the heat medium during the cooling and heating mixed operating mode. Meanwhile, the intermediate heat exchanger 25*b* is provided between the expansion device 26*b* and the second refrigerant channel switching device 28*b* on the refrigerant circuit A, serving to heat the heat medium during the cooling and heating mixed operating mode.

The two expansion devices 26 (expansion device 26*a*, expansion device 26*b*) have the function of a pressure-reducing valve or an expansion valve, depressurizing heat source side refrigerant to cause expansion. The expansion device 26*a* is provided on the upstream side of the intermediate heat exchanger 25*a* with respect to the flow of the heat source side refrigerant during cooling operation. The expansion device 26*b* is provided on the upstream side of the intermediate heat exchanger 25*b* with respect to the flow of the heat source side refrigerant during cooling operation. The two expansion devices 26 may have variably controllable opening degrees, and may be configured as an electronic expansion valve or the like, for example.

The two opening and closing devices (opening and closing device 27, opening and closing device 29) are made up of a solenoid valve or the like capable of opening and closing operation in response to a flow of electricity, opening and closing the refrigerant pipes 4. In other words, the two opening and closing devices are controlled to open and close according to the operating mode, and switch the flow channel of the heat source side refrigerant. The opening and closing device 27 is provided in the refrigerant pipe 4 on the inlet side of the heat source side refrigerant (the refrigerant pipe 4 positioned lowermost on the page from among the refrigerant pipes 4 connecting the outdoor unit 1 and the relay unit 2). The opening and closing device 29 is provided in a pipe (bypass pipe 20) connecting the refrigerant pipe 4 on the inlet side and the refrigerant pipe 4 on the outlet side of the heat source side refrigerant. Note that it is sufficient for the opening and closing device 27 and the opening and closing device 29 to be capable of switching the refrigerant flow channel, and a device capable of variably controlling the opening degree of an electronic expansion valve or the like may be used, for example.

The two second refrigerant channel switching devices 28 (second refrigerant channel switching device 28*a*, second refrigerant channel switching device 28*b*) are made up of a four-way valve or the like, for example, switching the flow of heat source side refrigerant according to the operating mode so that the intermediate heat exchangers 25 act as condensers or evaporators. The second refrigerant channel switching device 28*a* is provided on the downstream side of the intermediate heat exchanger 25*a* with respect to the flow of the heat source side refrigerant during cooling operation. The second refrigerant channel switching device 28*b* is provided on the downstream side of the intermediate heat exchanger 25*b* with respect to the flow of the heat source side refrigerant during the cooling only operating mode.

The two pumps 31 (pump 31*a*, pump 31*b*) circulate the heat medium conducted through the pipes 5 in a heat medium circuit B. The pump 31*a* is provided in a pipe 5 between the intermediate heat exchanger 25*a* and the second heat medium channel switching devices 33. The pump 31*b* is provided in a pipe 5 between the intermediate heat exchanger 25*b* and the second heat medium channel switching devices 33. The two pumps 31 may be configured as variable-capacity pumps, for example, and are configured to be able to regulate the flow rate depending on the magnitude of the load on the indoor units 3.

The four first heat medium channel switching devices 32 (first heat medium channel switching device 32*a* to first heat medium channel switching device 32*d*) are each made up of a three-way valve or the like, and switch the flow channel of the heat medium between the intermediate heat exchanger 25*a* and the intermediate heat exchanger 25*b*. The number of first heat medium channel switching devices 32 provided corresponds to the number of installed indoor units 3 (herein, four). Of the three ends of the first heat medium channel switching devices 32, one end is connected to the intermediate heat exchanger 25*a*, one end is connected to the intermediate heat exchanger 25*b*, and one end is connected to the heat medium flow control devices 34, and are provided on the outlet side of the heat medium channels of the use side heat exchangers 35. Note that the first heat medium channel switching devices 32 are indicated as a first heat medium channel switching device 32*a*, a first heat medium channel switching device 32*b*, a first heat medium channel switching device 32*c*, and a first heat medium channel switching device 32*d* from the top of the page, in correspondence with the indoor units 3. Also, the switching of a heat medium channel encompasses not only a complete switch from one to another, but also a partial switch from one to another.

The four second heat medium channel switching devices 33 (second heat medium channel switching device 33*a* to second heat medium channel switching device 33*d*) are each made up of a three-way valve or the like, and switch the flow channel of the heat medium between the intermediate heat exchanger 25*a* and the intermediate heat exchanger 25*b*. The number of second heat medium channel switching devices 33 provided corresponds to the number of installed indoor units 3 (herein, four). Of the three ends of the second heat medium channel switching devices 33, one end is connected to the intermediate heat exchanger 25*a*, one end is connected to the intermediate heat exchanger 25*b*, and one end is connected to the use side heat exchangers 35, and are provided on the inlet side of the heat medium channels of the use side heat exchangers 35. Note that the second heat medium channel switching devices 33 are indicated as a second heat medium channel switching device 33*a*, a second heat medium channel switching device 33*b*, a second heat medium channel switching device 33*c*, and a second heat medium channel switching device 33*d* from the top of the page, in correspondence with the indoor units 3. Also, the switching of a heat medium channel encompasses not only a complete switch from one to another, but also a partial switch from one to another.

The four heat medium flow control devices 34 (heat medium flow control device 34*a* to heat medium flow control device 34*d*) are each made up of a two-way valve or the like with a controllable opening surface area, and control the flow rate of heat medium flowing through the pipes 5. The number of heat medium flow control devices 34 provided corresponds to the number of installed indoor units 3 (herein, four). The heat medium flow control devices 34 are connected to the use side heat exchangers 35 on one end and to the first heat medium channel switching devices 32 on the other end, and are provided on the outlet side of the heat medium flow channel of the use side heat exchangers 35. In other words, the heat medium flow control devices 34 regulate the quantity of heat medium flowing into the indoor units 3 according to the temperature of heat medium flowing into, and the temperature of heat medium flowing out from, the indoor units 3, and are able to provide the indoor units 3 with an optimal quantity of heat medium according to the indoor load.

Note that the heat medium flow control devices 34 are indicated as a heat medium flow control device 34*a*, a heat medium flow control device 34*b*, a heat medium flow control device 34*c*, and a heat medium flow control device 34*d* from the top of the page, in correspondence with the indoor units 3. Also, the heat medium flow control devices 34 may be provided on the inlet side of the heat medium flow channels of the use side heat exchangers 35. Furthermore, the heat medium flow control devices 34 may be provided on the inlet side of the heat medium flow channels of the use side heat exchangers 35, provided between the second heat medium channel switching devices 33 and the use side heat exchangers 35. Moreover, when a load is not required in the indoor units 3, such as when air conditioning is shut down or when the thermostat is off, the heat medium flow control devices 34 may be completely closed to stop the supply of heat medium to the indoor units 3.

Note that if a device that additionally includes the functionality of the heat medium flow control devices 34 is used as the first heat medium channel switching devices 32 or the second heat medium channel switching devices 33, it is also possible to omit the heat medium flow control devices 34.

Also, in the relay unit 2, temperature sensors 40 (temperature sensor 40*a*, temperature sensor 40*b*) for detecting the temperature of heat medium on the outlet side of the intermediate heat exchangers 25 are provided. Information detected by the temperature sensors 40 (temperature information) is sent to a control device 50 that centrally controls operation of the air-conditioning apparatus 100, and is used to control factors such as the driving frequency of the compressor 10, the rotational speed of a blower device (not illustrated), the switching of the first refrigerant channel switching device 11, the driving frequency of the pumps 31, the switching of the second refrigerant channel switching devices 28, the switching of heat medium flow channels, and the regulation of the heat medium flow rate in the indoor units 3. Note that although an example of providing the control device 50 externally to the relay unit 2 and the indoor units 3 is illustrated, the configuration is not limited thereto, and the control device 50 may also be installed onboard the outdoor unit 1, the relay unit 2, or an indoor unit 3, or alternatively, communicably installed onboard each unit.

Also, the control device 50 is configured as a microcontroller or the like, and on the basis of detected information from various detection means and instructions from a remote control, controls each actuator (driving parts such as the pumps 31, the first heat medium channel switching devices 32, the second heat medium channel switching devices 33, the expansion devices 26, and the second refrigerant channel switching devices 28), such as the driving frequency of the compressor 10, the rotational speed of a blower device (including on/off), the switching of the first refrigerant channel switching device 11, the driving of the pumps 31, the opening degree of the expansion devices 26, the opening and closing of the opening and closing devices, the switching of the second refrigerant channel switching devices 28, the switching of the first heat medium channel switching devices 32, the switching of the second heat medium channel switching devices 33, and the driving of the heat medium flow control devices 34. In so doing, the control device 50 executes the respective operating modes discussed later, and also switches the heat medium flow channels to a heat medium heat storage tank.

The pipes 5 that conduct the heat medium are made up of those connected to the intermediate heat exchanger 25*a*, and those connected to the intermediate heat exchanger 25*b*. The pipes 5 are branched according to the number of indoor units 3 connected to the relay unit 2 (herein, a four-way branch each). Additionally, the pipes 5 are connected by the first heat medium channel switching devices 32 and the second heat medium channel switching devices 33. By controlling the first heat medium channel switching devices 32 and the second heat medium channel switching devices 33, it is decided whether to circulate heat medium from the intermediate heat exchanger 25*a* into the use side heat exchangers 35, or circulate heat medium from the intermediate heat exchanger 25*b* into the use side heat exchangers 35.

In addition, in the air-conditioning apparatus 100, the compressor 10, the first refrigerant channel switching device 11, the heat source side heat exchanger 12, the opening and closing device 27, the opening and closing device 29, the second refrigerant channel switching devices 28, the refrigerant channel of the intermediate heat exchangers 25, the expansion devices 26, and the accumulator 19 are connected by the refrigerant pipes 4 to constitute a refrigerant circuit A. Meanwhile, the heat medium channel of the intermediate heat exchangers 25, the pumps 31, the first heat medium channel switching devices 32, the heat medium flow control devices 34, the use side heat exchangers 35, and the second heat medium channel switching devices 33 are connected by the pipes 5 to constitute a heat medium circuit B. In other words, multiple use side heat exchangers 35 are connected in parallel to each of the intermediate heat exchangers 25, making the heat medium circuit B a multi-branch circuit.

Thus, in the air-conditioning apparatus 100, the outdoor unit 1 and the relay unit 2 are connected via the intermediate heat exchanger 25*a* and the intermediate heat exchanger 25*b* provided in the relay unit 2, while the relay unit 2 and the indoor units 3 are also connected via the intermediate heat exchanger 25*a* and the intermediate heat exchanger 25*b*. In other words, in the air-conditioning apparatus 100, heat is exchanged between the heat source side refrigerant circulating through the refrigerant circuit A and the heat medium circulating through the heat medium circuit B by the intermediate heat exchanger 25*a* and the intermediate heat exchanger 25*b*. By using such a configuration, the air-conditioning apparatus 100 is able to realize optimal cooling operation or heating operation according to the indoor load.

[Operating Modes]

The respective operating modes executed by the air-conditioning apparatus 100 will now be described. The air-conditioning apparatus 100 is capable of cooling operation or heating operation with each indoor unit 3, on the basis of an instruction from each indoor unit 3. In other words, the air-conditioning apparatus 100 is configured such that all of the indoor units 3 may operate identically, but also such that each of the indoor units 3 may operate differently.

The operating modes executed by the air-conditioning apparatus 100 include a cooling only operating mode in which all indoor units 3 being driven execute cooling operation, a heating only operating mode in which all indoor units 3 being driven execute heating operation, a cooling main operating mode in which the cooling load is larger than the heating load in a cooling and heating mixed operating mode, and a heating main operating mode in which the heating load is larger than the cooling load in a cooling and heating mixed operating mode.

Furthermore, there is a non-operating mode in which the operation of all of the outdoor unit 1, the relay unit 2, and the indoor units 3 shuts down, and neither cooling operation nor heating operation is conducted. In addition to the flow of heat source side refrigerant and heat medium in each operating mode described hereinafter, the flow of heat source side refrigerant and heat medium will also be described for transient operation when the operating mode of an indoor unit is changed from the non-operating mode to a cooling operation mode or a heating operation mode, or when switching from one of either cooling only operating mode or heating only operating mode to the other operating mode.

[Heating Only Operating Mode]

Figure 3:
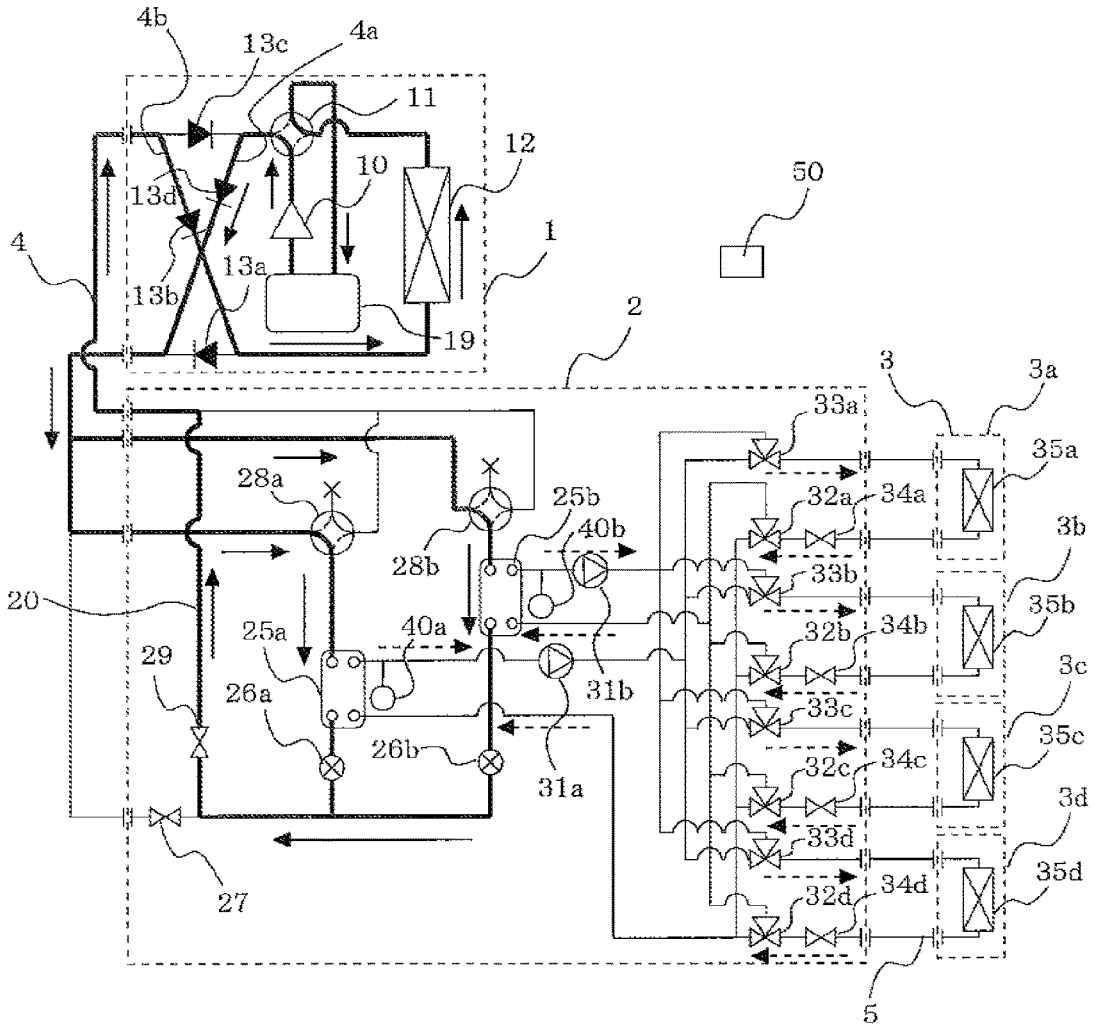
FIG. 3 is a refrigerant circuit diagram illustrating the flow of refrigerant during a heating only operating mode of an air-conditioning apparatus according to the Embodiment of the present invention.

FIG. 3 is a refrigerant circuit diagram illustrating the flow of refrigerant during a heating only operating mode of the air-conditioning apparatus 100. The heating only operating mode will be described with FIG. 3, taking as an example the case where a heating load is generated by all of the use side heat exchangers from the use side heat exchanger 35*a* to the use side heat exchanger 35*d*. Note that in FIG. 3, pipes indicated in bold represent pipes carrying heat source side refrigerant. Also, in FIG. 3, solid arrows indicate the direction of heat source side refrigerant flow, while dashed arrows indicate the direction of heat medium flow.

In the case of the heating only operating mode illustrated in FIG. 3, in the outdoor unit 1, the first refrigerant channel switching device 11 switches such that heat source side refrigerant discharged from the compressor 10 flows into the relay unit 2 without passing through the heat source side heat exchanger 12. In the relay unit 2, the pump 31*a* and the pump 31*b* are driven, the heat medium flow control device 34*a* to the heat medium flow control device 34*d* are fully opened, causing heat medium to circulate between each of the intermediate heat exchanger 25*a* and the intermediate heat exchanger 25*b*, and the use side heat exchanger 35*a* to the use side heat exchanger 35*d*, respectively. In addition, the second refrigerant channel switching device 28*a* and the second refrigerant channel switching device 28*b* are switched to the heating side, the opening and closing device 27 closes, and the opening and closing device 29 opens.

First, the flow of heat source side refrigerant in the refrigerant circuit A will be described.

Low temperature and low pressure gas refrigerant is compressed by the compressor 10 to become high temperature and high pressure gas refrigerant, and is discharged. The high temperature and high pressure gas refrigerant discharged from the compressor 10 goes through the first refrigerant channel switching device 11, is conducted through the refrigerant pipe 4*a*, passes through the check valve 13*d*, and flows out from the outdoor unit 1. The high temperature and high pressure gas refrigerant flowing out of the outdoor unit 1 flows into the relay unit 2 via the refrigerant pipes 4. The high temperature and high pressure gas refrigerant flowing into the relay unit 2 is branched, goes through the second refrigerant channel switching device 28*a* and the second refrigerant channel switching device 28*b*, and respectively flows into the intermediate heat exchanger 25*a* and the intermediate heat exchanger 25*b*.

The high temperature and high pressure gas refrigerant flowing into the intermediate heat exchanger 25*a* and the intermediate heat exchanger 25*b* condenses and liquefies to become high pressure liquid refrigerant while transferring heat to the heat medium circulating through the heat medium circuit B. The liquid refrigerant flowing out of the intermediate heat exchanger 25*a* and the intermediate heat exchanger 25*b* is expanded by the expansion device 26*a* and the expansion device 26*b* to become a low temperature and low pressure two-phase refrigerant. After converging, the two-phase refrigerant goes through the opening and closing device 29, flows out from the relay unit 2, goes through the refrigerant pipes 4, and once again flows into the outdoor unit 1. The refrigerant flowing into the outdoor unit 1 is conducted by the refrigerant connecting pipe 4*b*, passes through the check valve 13*b*, and flows into the heat source side heat exchanger 12 that acts as an evaporator.

Then, the heat source side refrigerant flowing into the heat source side heat exchanger 12 takes away heat from air in the outdoor space 6 (hereinafter designated outside air) at the heat source side heat exchanger 12, and becomes a low temperature and low pressure gas refrigerant. The low temperature and low pressure gas refrigerant flowing out of the heat source side heat exchanger 12 is once again suctioned into the compressor 10 via the first refrigerant channel switching device 11 and the accumulator 19.

At this point, the opening degree of the expansion devices 26 is controlled such that the subcooling (degree of subcooling) obtained as the difference between the temperature detected on the outlet side of the intermediate heat exchangers 25, and a value obtained by converting the pressure of the heat source side refrigerant between the intermediate heat exchangers 25 and the expansion devices 26 into a saturation temperature, becomes constant. Note that in the case where the temperature at an intermediate position between the intermediate heat exchangers 25 can be measured, the temperature at that intermediate position may be used instead of the converted saturation temperature. In this case, the installation of a pressure sensor may be omitted, and the system may be configured at lower cost.

Next, the flow of heat medium in the heat medium circuit B will be described.

In the heating only operating mode, the heating energy of the heat source side refrigerant is transferred to the heat medium in both the intermediate heat exchanger 25*a* and the intermediate heat exchanger 25*b*, and the heated heat medium is made to flow inside the pipes 5 by the pump 31*a* and the pump 31*b*. Outflowing heat medium pressurized by the pump 31*a* and the pump 31*b* flows into the use side heat exchanger 35*a* to the use side heat exchanger 35*d* via the second heat medium channel switching device 33*a* to the second heat medium channel switching device 33*d*. Then, the heat medium transfers heat to the indoor air at the use side heat exchanger 35*a* to the use side heat exchanger 35*d*, thereby heating the indoor space 7.

Subsequently, the heat medium flows out from the use side heat exchanger 35*a* to the use side heat exchanger 35*d*, and flows into the heat medium flow control device 34*a* to the heat medium flow control device 34*d*. At this point, the heat medium is made to flow into the use side heat exchanger 35*a* to the use side heat exchanger 35*d* at a flow rate controlled by the action of the heat medium flow control device 34*a* to the heat medium flow control device 34*d*, this flow rate being the flow rate of heat medium necessary to cover the air conditioning load required indoors. The heat medium flowing out from the heat medium flow control device 34*a* to the heat medium flow control device 34*d* passes through the first heat medium channel switching device 32*a* to the first heat medium channel switching device 32*b*, flows into the intermediate heat exchanger 25*a* and the intermediate heat exchanger 25*b*, receives from the refrigerant side a quantity of heat to supply to the indoor space 7 via the indoor units 3, and is once again suctioned into the pump 31*a* and the pump 31*b*.

Note that inside the pipes 5 of the use side heat exchangers 35, the heat medium flows in the direction going from the second heat medium channel switching devices 33 to the first heat medium channel switching devices 32 via the heat medium flow control devices 34. In addition, the air conditioning load required in the indoor space 7 may be covered by applying control to keep the difference between the temperature detected by the first temperature sensor 40*a* or the temperature detected by the temperature sensor 40*b*, versus the temperature of heat medium flowing out from the use side heat exchangers 35, at a target value. The temperature of either the temperature sensor 40*a* or the temperature sensor 40*b* may be used as the outlet temperature of the intermediate heat exchangers 25, or their average temperature may be used.

At this point, the first heat medium channel switching devices 32 and the second heat medium channel switching devices 33 are set to intermediate opening degrees to maintain channels flowing into both the intermediate heat exchanger 25*a* and the intermediate heat exchanger 25*b*, or controlled to an opening degree according to the heat medium temperature at the outlet of the intermediate heat exchanger 25*a* and the intermediate heat exchanger 25*b*. Also, although the use side heat exchangers 35 should ideally apply control according to the inlet versus outlet temperature difference, the heat medium temperature on the inlet side of the use side heat exchangers 35 is nearly the same temperature as the temperature detected by the temperature sensor 40*b*, and thus using the temperature sensor 40*b* enables a reduction in the number of temperature sensors, making it possible to configure the system at lower cost.

When executing the heating only operating mode, it is not necessary for the heat medium to flow to use side heat exchangers 35 with no heat load (including those switched off by thermostat control). For this reason, the heat medium is made to not flow to such use side heat exchangers 35 by closing channels with the heat medium flow control devices 34. In FIG. 3, heat medium is made to flow because there are heat loads on all of the use side heat exchangers from the use side heat exchanger 35*a* to the use side heat exchangers 3*d*, but if a heat load ceases to exist, the corresponding heat medium flow control device 34 may be fully closed. Subsequently, if a heat load is produced again, the corresponding heat medium flow control device 34 may be opened to allow the circulation of heat medium. This applies similarly to the other operating modes described below.

[Cooling Only Operating Mode]

Figure 4:
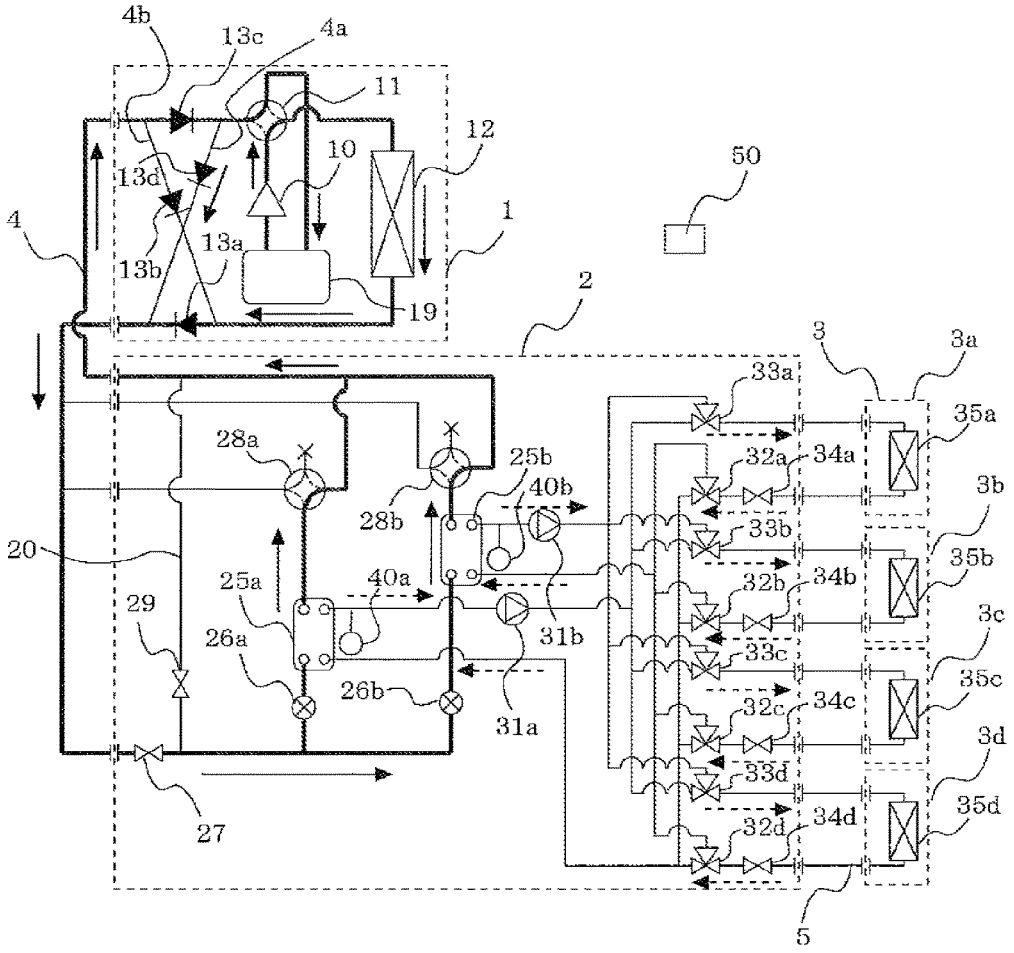
FIG. 4 is a refrigerant circuit diagram illustrating the flow of refrigerant during a cooling only operating mode of the air-conditioning apparatus according to the Embodiment of the present invention.

FIG. 4 is a refrigerant circuit diagram illustrating the flow of refrigerant during a cooling only operating mode of the air-conditioning apparatus 100. The cooling only operating mode will be described with FIG. 4, taking as an example the case where a cooling load is generated by all of the use side heat exchangers from the use side heat exchanger 35*a* to the use side heat exchanger 35*d*. Note that in FIG. 4, pipes indicated in bold represent pipes carrying heat source side refrigerant. Also, in FIG. 4, solid arrows indicate the direction of heat source side refrigerant flow, while dashed arrows indicate the direction of heat medium flow.

In the case of the cooling only operating mode illustrated in FIG. 4, in the outdoor unit 1, the first refrigerant channel switching device 11 switches such that heat source side refrigerant discharged from the compressor 10 flows into the heat source side heat exchanger 12.

In the relay unit 2, the pump 31*a* and the pump 31*b* are driven, the heat medium flow control device 34*a* to the heat medium flow control device 34*d* are fully opened, causing heat medium to circulate between each of the intermediate heat exchanger 25*a* and the intermediate heat exchanger 25*b*, and the use side heat exchanger 35*a* to the use side heat exchanger 35*d*, respectively. In addition, the second refrigerant channel switching device 28*a* and the second refrigerant channel switching device 28*b* are switched to the cooling side, the opening and closing device 27 opens, and the opening and closing device 29 closes.

First, the flow of heat source side refrigerant in the refrigerant circuit A will be described.

Low temperature and low pressure gas refrigerant is compressed by the compressor 10 to become high temperature and high pressure gas refrigerant, and is discharged. The high temperature and high pressure gas refrigerant discharged from the compressor 10 passes through the heat source side heat exchanger 12, exchanges heat with outside air to become high temperature and high pressure liquid or two-phase refrigerant, and after passing through the check valve 13*a*, is conducted through the refrigerant connecting pipe 4*a*, and flows out from the outdoor unit 1. The high temperature and high pressure liquid or two-phase refrigerant flowing out of the outdoor unit 1 flows into the relay unit 2 via the refrigerant pipes 4.

After passing through the opening and closing device 27, the high temperature and high pressure liquid or two-phase refrigerant flowing into the relay unit 2 is branched and expanded by the expansion device 26*a* and the expansion device 26*b* to become a low temperature and low pressure two-phase refrigerant. These flows of two-phase refrigerant evaporate while absorbing heat from heat medium circulating through the heat medium circuit B, and become low temperature gas refrigerant. The gas refrigerant flowing out from the intermediate heat exchanger 25*a* and the intermediate heat exchanger 25*b* flows out of the relay unit 2 via the second refrigerant channel switching device 28*a* and the second refrigerant channel switching device 28*b*, is conducted through the refrigerant pipes 4, passes through the check valve 13*c*, and is suctioned into the compressor 10 again via the first refrigerant channel switching device 11 and the accumulator 19.

At this point, the opening degree of the expansion devices 26 is controlled such that the superheat (degree of superheat) obtained as the difference between the temperature detected on the outlet side of the intermediate heat exchangers 25, and a value obtained by converting the pressure of the heat source side refrigerant between the intermediate heat exchangers 25 and the expansion devices 26 into a saturation temperature, becomes constant. Note that in the case where the temperature at an intermediate position between the intermediate heat exchangers 25 can be measured, the temperature at that intermediate position may be used instead of the converted saturation temperature. In this case, the installation of a pressure sensor may be omitted, and the system may be configured at lower cost.

Next, the flow of heat medium in the heat medium circuit B will be described.

In the cooling only operating mode, the cooling energy of the heat source side refrigerant is transferred to the heat medium in both the intermediate heat exchanger 25*a* and the intermediate heat exchanger 25*b*, and the cooled heat medium is pressurized by the pump 31*a* and the 31*b* and flows out, flowing into the use side heat exchanger 35*a* to use side heat exchanger 35*d* via the second heat medium channel switching device 33*a* to second heat medium channel switching device 33*d*. Then, the heat medium absorbs heat from the indoor air at the use side heat exchanger 35*a* to the use side heat exchanger 35*d*, thereby cooling the indoor space 7.

Subsequently, the heat medium flows out from the use side heat exchanger 35*a* to the use side heat exchanger 35*d*, and flows into the heat medium flow control device 34*a* to the heat medium flow control device 34*d*. At this point, the heat medium is made to flow into the use side heat exchanger 35*a* to the use side heat exchanger 35*d* at a flow rate controlled by the action of the heat medium flow control device 34*a* to the heat medium flow control device 34*d*, this flow rate being the flow rate of heat medium necessary to cover the air conditioning load required indoors. The heat medium flowing out from the heat medium flow control device 34*a* to the heat medium flow control device 34*d* passes through the first heat medium channel switching device 32*a* to the first heat medium channel switching device 32*b*, flows into the intermediate heat exchanger 25*a* and the intermediate heat exchanger 25*b*, passes to the refrigerant side the quantity of heat taken away from the indoor space 7 via the indoor units 3, and is once again suctioned into the pump 31*a* and the pump 31*b*.

Note that inside the pipes 5 of the use side heat exchangers 35, the heat medium flows in the direction going from the second heat medium channel switching devices 33 to the first heat medium channel switching devices 32 via the heat medium flow control devices 34. In addition, the air conditioning load required in the indoor space 7 may be covered by applying control to keep the difference between the temperature detected by the temperature sensor 40*a* or the temperature detected by the temperature sensor 40*b*, versus the temperature of heat medium flowing out from the use side heat exchangers 35, at a target value. The temperature of either the temperature sensor 40*a* or the temperature sensor 40*b* may be used as the outlet temperature of the intermediate heat exchangers 25, or their average temperature may be used.

At this point, the first heat medium channel switching devices 32 and the second heat medium channel switching devices 33 are set to intermediate opening degrees to maintain channels flowing into both the intermediate heat exchanger 25*a* and the intermediate heat exchanger 25*b*, or controlled to an opening degree according to the heat medium temperature at the outlet of the intermediate heat exchanger 25*a* and the intermediate heat exchanger 25*b*. Also, although the use side heat exchangers 35 should ideally apply control according to the inlet versus outlet temperature difference, the heat medium temperature on the inlet side of the use side heat exchangers 35 is nearly the same temperature as the temperature detected by the temperature sensor 40*b*, and thus using the temperature sensor

40*b* enables a reduction in the number of temperature sensors, making it possible to configure the system at lower cost.

[Cooling and Heating Mixed Operating Mode]

Figure 5:
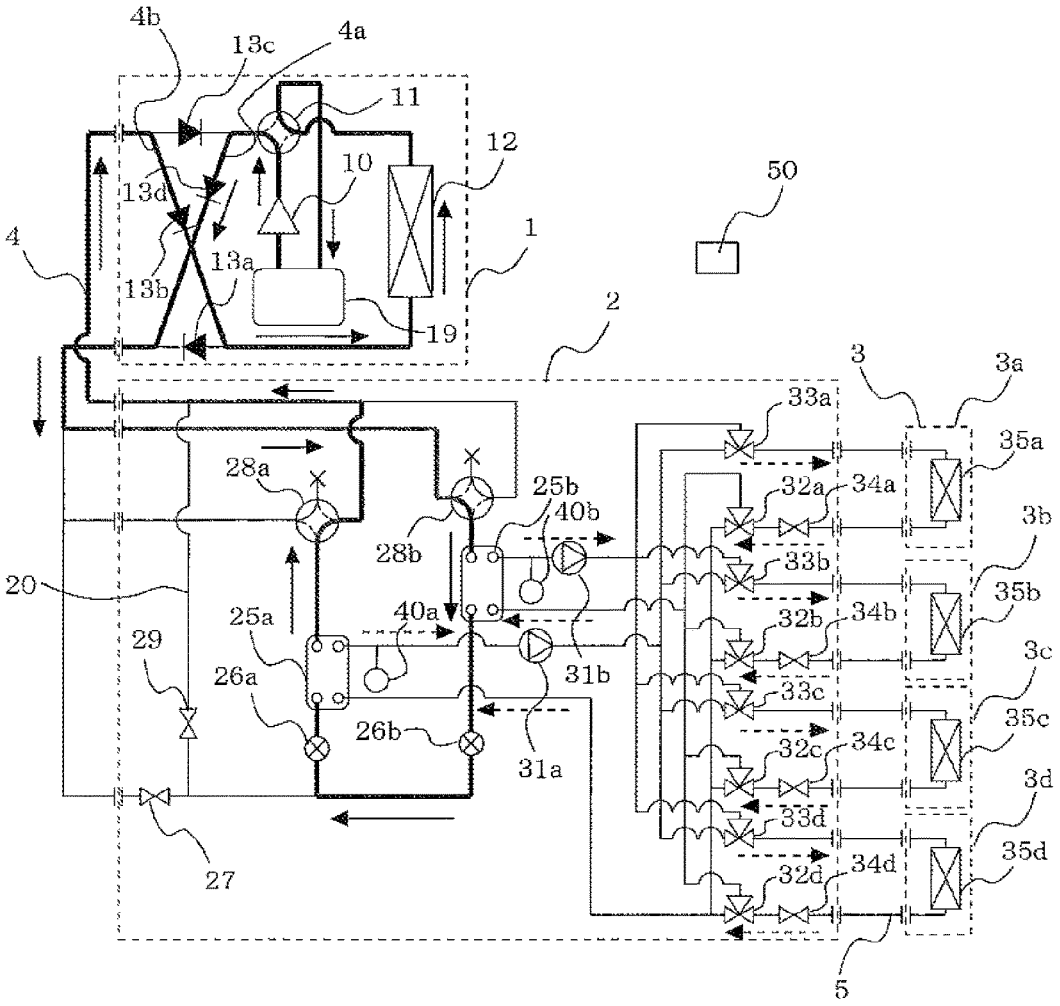
FIG. 5 is a refrigerant circuit diagram illustrating the flow of refrigerant during a cooling and heating mixed operating mode of the air-conditioning apparatus according to the Embodiment of the present invention.

FIG. 5 is a refrigerant circuit diagram illustrating the flow of refrigerant during a cooling and heating mixed operating mode of the air-conditioning apparatus 100. Of cooling and heating mixed operation, which is the case in which a heating load is produced at some of the use side heat exchangers 35, while a cooling load is produced at the remaining use side heat exchangers 35, a heating main operating mode will be described using FIG. 5. FIG. 5 illustrates, as an example, a state in which a cooling load is produced at the use side heat exchangers 35*a* and 35*b*, while a heating load is produced at the use side heat exchangers 35*c* and 35*d*. Note that in FIG. 5, pipes indicated in bold represent pipes circulating heat source side refrigerant. Also, in FIG. 5, solid arrows indicate the direction of heat source side refrigerant flow, while dashed arrows indicate the direction of heat medium flow.

In the case of the heating main operating mode illustrated in FIG. 5, in the outdoor unit 1, the first refrigerant channel switching device 11 switches such that heat source side refrigerant discharged from the compressor 10 flows into the relay unit 2 without passing through the heat source side heat exchanger 12. In the relay unit 2, the pump 31*a* and the pump 31*b* are driven, the heat medium flow control device 34*a* to the heat medium flow control device 34*d* are opened, causing heat medium to circulate between the intermediate heat exchanger 25*a* and the use side heat exchangers 35 where a cooling load is produced, and between the intermediate heat exchanger 25*b* and the use side heat exchangers 35 where a heating load is produced, respectively. In addition, the second refrigerant channel switching device 28*a* is switched to the cooling side while the second refrigerant channel switching device 28*b* is switched to the heating side, the expansion device 26*a* fully opens, the opening and closing device 27 closes, and the opening and closing device 29 closes.

First, the flow of heat source side refrigerant in the refrigerant circuit A will be described.

Low temperature and low pressure gas refrigerant is compressed by the compressor 10 to become high temperature and high pressure gas refrigerant, and is discharged. The high temperature and high pressure gas refrigerant discharged from the compressor 10 goes through the first refrigerant channel switching device 11, is conducted through the refrigerant pipe 4*a*, passes through the check valve 13*d*, and flows out from the outdoor unit 1. The high temperature and high pressure gas refrigerant flowing out of the outdoor unit 1 flows into the relay unit 2 via the refrigerant pipes 4. The high temperature and high pressure gas refrigerant flowing into the relay unit 2 goes through the second refrigerant channel switching device 28*b*, and flows into the intermediate heat exchanger 25*b* which acts as a condenser.

The gas refrigerant flowing into the intermediate heat exchanger 25*b* condenses and liquefies to become liquid refrigerant while transferring heat to the heat medium circulating through the heat medium circuit B. The liquid refrigerant flowing out of the intermediate heat exchanger 25*b* is expanded by the expansion device 26*b* to become low pressure two-phase refrigerant. This low pressure two-phase refrigerant flows via the expansion device 26*a* into the intermediate heat exchanger 25*a*, which acts as an evaporator. The low pressure two-phase refrigerant flowing into the intermediate heat exchanger 25*a* evaporates by taking away heat from the heat medium circulating through the heat medium circuit B, thus cooling the heat medium. This low pressure two-phase refrigerant flows out of the intermediate heat exchanger 25*a*, flows out of the relay unit 2 via the second refrigerant channel switching device 28*a*, and once again flows into the outdoor unit 1 via the refrigerant pipes 4.

The low temperature and low pressure two-phase refrigerant flowing into the outdoor unit 1 passes through the check valve 13*b*, and flows into the heat source side heat exchanger 12 that acts as an evaporator. Then, the refrigerant flowing into the heat source side heat exchanger 12 takes away heat from the outside air at the heat source side heat exchanger 12, and becomes a low temperature and low pressure gas refrigerant. The low temperature and low pressure gas refrigerant flowing out of the heat source side heat exchanger 12 is once again suctioned into the compressor 10 via the first refrigerant channel switching device 11 and the accumulator 19.

Note that the opening degree of the expansion device 26*b* is controlled so that the subcooling (degree of subcooling) of the refrigerant at the outlet of the intermediate heat exchanger 25*b* becomes a target value. Note that the expansion device 26*b* may also be fully opened, and the subcooling may be controlled with the expansion device 26*a*.

Next, the flow of heat medium in the heat medium circuit B will be described.

In the heating main operating mode, the heating energy of the heat source side refrigerant is transferred to the heat medium in the intermediate heat exchanger 25*b*, and the heated heat medium is made to flow inside the pipes 5 by the pump 31*b*. Also, in the heating main operating mode, the cooling energy of the heat source side refrigerant is transferred to the heat medium in the intermediate heat exchanger 25*a*, and the cooled heat medium is made to flow inside the pipes 5 by the pump 31*a*. Outflowing cooled heat medium pressurized by the pump 31*a* flows into the use side heat exchangers 35 where a cooling is produced via the second heat medium channel switching devices 33, while outflowing heat medium pressurized by the pump 31*b* flows into the use side heat exchangers 35 where a heating load is produced via the second heat medium channel switching devices 33.

At this point, when a connected indoor unit 3 is in the heating operation mode, the relevant second heat medium channel switching device 33 is switched in the direction connected to the intermediate heat exchanger 25*b* and the pump 31*b*, whereas when a connected indoor unit 3 is in the cooling operation mode, the relevant second heat medium channel switching device 33 is switched in the direction connected to the intermediate heat exchanger 25*a* and the pump 31*a*. In other words, it is possible to switch the heat medium supplied to the indoor units 3 between heating and cooling using the second heat medium channel switching devices 33.

The use side heat exchangers 35 conduct cooling operation of the indoor space 7 by having heat medium take away heat from the indoor air, or heating operation of the indoor space 7 by having heat medium transfer heat to the indoor air. At this point, the heat medium is made to flow into the use side heat exchangers 35*s* at a flow rate controlled by the action of the heat medium flow control devices 34, this flow rate being the flow rate of heat medium necessary to cover the air conditioning load required indoors.

The heat medium with slightly raised temperature that was used for cooling operation and passed through the use side heat exchangers 35 goes through the heat medium flow control devices 34 and the first heat medium channel switching devices 32, flows into the intermediate heat exchanger 25*a*, and is once again suctioned into the pump 31*a*. The heat medium with slightly lowered temperature that was used for heating operation and passed through the use side heat exchangers 35 goes through the heat medium flow control devices 34 and the first heat medium channel switching devices 32, flows into the intermediate heat exchanger 25*b*, and is once again suctioned into the pump 31*a*. At this point, when a connected indoor unit 3 is in the heating operation mode, the relevant first heat medium channel switching device 32 is switched in the direction connected to the intermediate heat exchanger 25*b* and the pump 31*b*, whereas when a connected indoor unit 3 is in the cooling operation mode, the relevant first heat medium channel switching device 32 is switched in the direction connected to the intermediate heat exchanger 25*a* and the pump 31*a*.

Meanwhile, the warm heat medium and the cool heat medium is introduced into use side heat exchangers 35 having a heating load and a cooling load, respectively, and due to the action of the first heat medium channel switching devices 32 and the second heat medium channel switching devices 33, the heat medium does not mix. As a result, heat medium used in the heating operation mode is made to flow into the intermediate heat exchanger 25*b* that transfers heat from the refrigerant to the heat medium for the purpose of heating, while heat medium used in the cooling operation mode is made to flow into the intermediate heat exchanger 25*a* that transfers heat from the heat medium to the refrigerant for the purpose of cooling, and after respectively exchanging heat with the refrigerant again, the heat medium is transported to the pump 31*a* and the pump 31*b*.

Note that inside the pipes 5 of the use side heat exchangers 35, on both the heating side and the cooling side, the heat medium flows in the direction going from the second heat medium channel switching devices 33 to the first heat medium channel switching devices 32 via the heat medium flow control devices 34. In addition, the air conditioning load required in the indoor space 7 may be covered by applying control to keep the difference between the temperature detected by the temperature sensor 40*b* versus the temperature of the heat medium flowing out from the use side heat exchangers 35 at a target value on the heating side, while keeping the difference between the temperature detected by the temperature sensor 40*a* versus the temperature of heat medium flowing out from the use side heat exchangers 35 at a target value on the cooling side.

In addition, during the cooling and heating mixed operating mode in the air-conditioning apparatus 100 of FIG. 5, even in the cooling main operating mode of the mixed operation in the case in which a cooling load is produced at any of the use side heat exchangers 35 while a heating load is produced at the remaining use side heat exchangers 35, the flow of heat source side refrigerant in the refrigerant circuit A and the flow of heat medium in the heat medium circuit B are similar to the heating main operating mode.

[Cooling Activation Mode]

FIG. 6 is an explanatory diagram for the case in which any of the indoor units 3 transitions from the non-operating mode to cooling operation. FIG. 6(*a*) is an explanatory diagram of operation of the relay unit 2 and the indoor units 3, while FIG. 6(*b*) is an explanatory diagram of the flows of heat source side refrigerant and heat medium, as well as the operation of the blower device of the indoor units 3. A cooling activation mode conducted when transitioning from the non-operating mode to cooling operation will be described with reference to FIG. 6.

Note that in FIG. 6(*b*), solid arrows indicate the direction of heat source side refrigerant flow, while dashed arrows indicate the direction of heat medium flow. Also, in FIG. 6(*b*), illustration of the refrigerant circuit A and the heat medium circuit B is simplified in accordance with the system configuration diagram illustrated in FIG. 2. In other words, although FIG. 6(*b*) illustrates one indoor unit 3 performing cooling operation, and one use side heat exchanger 35 connected to one relay unit 2, the configuration is not limited thereto. The flow channels may also be switched by first heat medium channel switching devices 32 and second heat medium channel switching devices 33 so that multiple use side heat exchangers 35 are connected to a single relay unit 2, and there may be multiple indoor units 3 performing cooling operation.

Herein, let a non-operating mode be defined as the case in which there is no flow of heat source side refrigerant and no flow of heat medium in the refrigerant circuit A and the heat medium circuit B, or in other words, the case in which all component parts on the refrigerant circuit A and the heat medium circuit B are in a stopped state.

Also, let a cooling activation mode be defined as an operating mode that controls actuators and the like onboard the relay unit 2, such as a pump 31, a first heat medium channel switching device 32, a second heat medium channel switching device 33, and a heat medium flow control device 34, to perform cooling operation from a non-operating mode. The cooling activation mode is also included in cooling operation.

The cooling activation mode starts when transitioning from the non-operating mode to the cooling activation mode, and the cooling activation mode ends when the operation of components such as the pump 31, first heat medium channel switching device 32, second heat medium channel switching device 33, and heat medium flow control device 34 is complete.

To perform cooling operation for an indoor unit 3, the control device 50 transitions to the cooling activation mode, and activates the compressor 10 and the pump 31.

In addition, the control device 50 controls the switching of flow channels by the first heat medium channel switching device 32 and the second heat medium channel switching device 33 so that heat medium is transported to the use side heat exchanger 35 corresponding to the indoor unit 3 that is to start cooling operation, and in addition, opens the heat medium flow control device 34 to circulate heat medium between the use side heat exchanger 35 and the intermediate heat exchanger 25 (see Operation (1) in FIG. 6).

In this way, after transitioning to cooling activation mode, heat source side refrigerant is made to flow from the outdoor unit 1 side immediately to the intermediate heat exchanger 25 side in the relay unit 2, thereby enabling stable heat source side refrigerant circulation. Likewise in the heat medium circuit B, after transitioning to cooling activation mode, by immediately driving the pump 31, switching the flow channels of the first heat medium channel switching device 32 and the second heat medium channel switching device 33, and opening the heat medium flow control device 34, stable heat medium circuit is enabled. As a result, since stable heat source side refrigerant circulation and stable heat medium circulation are realized, the air-conditioning apparatus 100 conducts heat exchange between heat source side refrigerant and heat medium in the intermediate heat exchanger 25 at high efficiency.

Furthermore, the control device 50 controls the indoor unit 3 from which the start command is originated to immediately start operation of the blower device of the use side heat exchanger 35 corresponding to that indoor unit 3 (see Operation (2) in FIG. 6). Note that the control device 50 operates the blower device at a preconfigured flow rate immediately after operation is started.

At this point, if the first heat medium channel switching device 32, the second heat medium channel switching device 33, and the heat medium flow control device 34 are switched or regulated to a specific opening degree by pulse regulation such as in a stepping motor, for example, the first heat medium channel switching device 32, the second heat medium channel switching device 33, and the heat medium flow control device 34 may be controlled as follows.

Namely, the control device 50 may simultaneously switch the flow channels in the first heat medium channel switching device 32 and the second heat medium channel switching device 33 while also opening the heat medium flow control device 34. Consequently, the flow channel of the heat medium circuit B is ensured, enabling heat medium to be circulated reliably.

Additionally, the control device 50 may switch the first heat medium channel switching device 32 and the second heat medium channel switching device 33 and additionally open the heat medium flow control device 34, before operating the pump 31. In this way, if the first heat medium channel switching device 32, the second heat medium channel switching device 33, and the heat medium flow control device 34 are configured using a stepping motor or the like, a time difference may be provided between the operation of the pump 31, and the operation of the first heat medium channel switching device 32, the second heat medium channel switching device 33, and the heat medium flow control device 34. Consequently, the flow channel of the heat medium circuit B is ensured, enabling heat medium to be circulated reliably.

At the start of the cooling activation mode, heat source side refrigerant is not transported all the way to the indoor unit 3 as in a multi-air conditioning system for a building of the related art, and is instead positioned inside the relay unit 2 and the outdoor unit 1. For this reason, immediately after starting the cooling activation mode, a transient insufficiency of heat source side refrigerant in the refrigerant circuit A may be minimized and operation of the refrigerant circuit A may be stabilized, enabling a smooth transition to cooling operation.

Also, immediately after the start of the cooling activation mode, the heat medium transported to the use side heat exchanger 35 does not exchange heat with the heat source side refrigerant, and is at a temperature close to the ambient temperature where the use side heat exchanger 35 is installed.

For this reason, in the Embodiment, immediately after transitioning from the non-operating mode to the cooling activation mode, the control device 50 activates the blower device (not illustrated) of the use side heat exchanger 35 corresponding to the indoor unit 3 to perform cooling operation.

At this point, if the temperature of the air to supply to a user is approximately the ambient temperature of the use side heat exchanger 35, air may be sent to the user and take evaporation heat from the user, without feeling like hot air. In other words, immediately after transitioning from the non-operating mode to the cooling activation mode, even if the blower device (not illustrated) is activated and air is supplied to the indoor space, user comfort may be improved without causing the user to feel hot air.

[Heating Activation Mode]

FIG. 7 is an explanatory diagram for the case in which any of the indoor units 3 transitions from the non-operating mode to heating operation. FIG. 7(*a*) is an explanatory diagram of operation of the relay unit 2 and the indoor units 3, while FIG. 7(*b*) is an explanatory diagram of the flows of heat source side refrigerant and heat medium, as well as the operation of the blower device of the indoor units 3. A heating activation mode conducted when transitioning from the non-operating mode to heating operation will be described with reference to FIG. 7.

Note that in FIG. 7(*b*), solid arrows indicate the direction of heat source side refrigerant flow, while dashed arrows indicate the direction of heat medium flow. Also, in FIG. 7(*b*), illustration of the refrigerant circuit A and the heat medium circuit B is simplified in accordance with the system configuration diagram illustrated in FIG. 2. In other words, although FIG. 7(*b*) illustrates one indoor unit 3 performing heating operation, and one use side heat exchanger 35 connected to one relay unit 2, the configuration is not limited thereto. The flow channels may also be switched by first heat medium channel switching devices 32 and second heat medium channel switching devices 33 so that multiple use side heat exchangers 35 are connected to a single relay unit 2, and there may be multiple indoor units 3 performing heating operation.

Herein, let a heating activation mode be defined as an operating mode that controls actuators and the like onboard the relay unit 2, such as a pump 31, a first heat medium channel switching device 32, a second heat medium channel switching device 33, and a heat medium flow control device 34, to perform heating operation from a non-operating mode. The heating activation mode is also included in heating operation.

The heating activation mode starts when transitioning from the non-operating mode to the heating activation mode, and the heating activation mode ends when the operation of components such as the pump 31, first heat medium channel switching device 32, second heat medium channel switching device 33, and heat medium flow control device 34 is complete.

To perform heating operation for an indoor unit 3, the control device 50 transitions to the heating activation mode, and activates the compressor 10 and the pump 31.

In addition, the control device 50 controls the switching of flow channels by the first heat medium channel switching device 32 and the second heat medium channel switching device 33 so that heat medium is transported to the use side heat exchanger 35 corresponding to the indoor unit 3 that is to start heating operation, and in addition, opens the heat medium flow control device 34 to circulate heat medium between the use side heat exchanger 35 and the intermediate heat exchanger 25 (see Operation (1) in FIG. 7).

In this way, after transitioning to heating activation mode, heat source side refrigerant is made to flow from the heat source side outdoor unit 1 side immediately to the intermediate heat exchanger 25 side in the relay unit 2, thereby enabling stable heat source side refrigerant circulation. Likewise in the heat medium circuit B, after transitioning to heating activation mode, by immediately driving the pump 31, switching the flow channels of the first heat medium channel switching device 32 and the second heat medium channel switching device 33, and opening the heat medium flow control device 34, stable heat medium circuit is enabled. As a result, since stable heat source side refrigerant circulation and stable heat medium circulation are realized, the air-conditioning apparatus 100 conducts heat exchange between heat source side refrigerant and heat medium in the intermediate heat exchanger 25 at high efficiency.

Furthermore, the control device 50 does not immediately operate the blower device of the indoor unit 3 from which the heating operation start instruction is originated, and instead stops the blower device for a preconfigured time. Subsequently, after the preconfigured time elapses, the control device 50 starts operation of the blower device, but sets the flow rate of the blower device to a smaller flow rate (Very Low) than the preconfigured flow rate for heating operation.

After the operation of actuators such as the pump 31, the first heat medium channel switching device 32, the second heat medium channel switching device 33, and the heat medium flow control device 34 completes, and the heating activation mode ends, the control device 50 transitions to heating operation, and raises the flow rate of the blower device. However, the flow rate of the blower device is set to a smaller flow rate (Low) than the preconfigured flow rate for heating operation.

Subsequently, when the temperature of the heat medium reaches a preconfigured temperature according to a detection result from the temperature sensor 40, the control device 50 raises the flow rate even further, and causes the blower device to operate at the preconfigured flow rate for heating operation (see Operation (2) in FIG. 7). Note that the preconfigured temperature may be configured to the indoor temperature where the indoor unit 3 is provided, for example. The preconfigured temperature may also be greater than the indoor temperature.

In the Embodiment, when transitioning from the non-operating mode to heating operation, the flow rate is gradually increased to a preconfigured flow rate after being set to Very Low and Low first, but the configuration is not limited thereto. For example, the blower device of the indoor unit 3 from which the heating operation start command is originated may also be made to operate after the temperature of heat medium reaches a preconfigured temperature, without being set to Very Low and Low first.

At this point, if the first heat medium channel switching device 32, the second heat medium channel switching device 33, and the heat medium flow control device 34 are switched or regulated to a specific opening degree by pulse regulation such as in a stepping motor, for example, the first heat medium channel switching device 32, the second heat medium channel switching device 33, and the heat medium flow control device 34 may be controlled as follows.

Namely, the control device 50 may simultaneously switch the flow channels in the first heat medium channel switching device 32 and the second heat medium channel switching device 33 while also opening the heat medium flow control device 34. Consequently, the flow channel of the heat medium circuit B is ensured, enabling heat medium to be circulated reliably.

Additionally, the control device 50 may switch the first heat medium channel switching device 32 and the second heat medium channel switching device 33 and additionally open the heat medium flow control device 34, before operating the pump 31. In this way, if the first heat medium channel switching device 32, the second heat medium channel switching device 33, and the heat medium flow control device 34 are configured using a stepping motor or the like, a time difference may be provided between the operation of the pump 31, and the operation of the first heat medium channel switching device 32, the second heat medium channel switching device 33, and the heat medium flow control device 34. Consequently, the flow channel of the heat medium circuit B is ensured, enabling heat medium to be circulated reliably.

At the start of the heating activation mode, heat source side refrigerant is not transported all the way to the indoor unit 3 as in a multi-air conditioning system for a building of the related art, and is instead positioned inside the relay unit 2 and the heat source side outdoor unit 1. For this reason, immediately after starting the heating activation mode, a transient insufficiency of heat source side refrigerant in the refrigerant circuit A may be minimized and operation of the refrigerant circuit A may be stabilized, enabling a smooth transition to heating operation.

Also, immediately after the start of the heating activation mode, the heat medium transported to the use side heat exchanger 35 does not exchange heat with the heat source side refrigerant, and is at a temperature close to the ambient temperature where the use side heat exchanger 35 is installed. For this reason, if the blower device of the indoor unit 3 is activated immediately after transitioning to the heating activation mode, user comfort may be degraded. In other words, in a season such as winter when heating operation is performed, for example, the indoor air temperature is often low enough to make the user feel uncomfortable. Consequently, operating the blower device immediately after transitioning to the heating activation mode may cause the user to feel cold air, and degrade user comfort.

Accordingly, in the Embodiment, immediately after transitioning from the non-operating mode to the heating activation mode, the control device 50 stops the blower device (not illustrated) of the use side heat exchanger 35 corresponding to the indoor unit 3 to perform heating operation. Subsequently, as time passes, heat is exchanged between the heat medium and the heat source side refrigerant, and the heat medium gradually warms up, and thus the blower device is operated at Very Low. When the heating activation mode ends, the heat medium temperature has risen further, and thus the flow rate of the blower device is increased to Low. Subsequently, when the temperature of the heat medium reaches a preconfigured temperature, the blower device is made to operate at a preconfigured flow rate. As a result, user comfort may be improved without causing the user to feel cold air.

[Advantageous Effects of Air-conditioning Apparatus 100 According to Embodiment]

In the air-conditioning apparatus 100 according to the Embodiment, when transitioning from a non-operating mode to a cooling activation mode for cooling operation, the blower device (not illustrated) of an indoor unit 3 is immediately activated, thereby enabling a fast start of cooling operation, while also improving user comfort without causing the user to feel hot air.

In the air-conditioning apparatus 100 according to the Embodiment, when transitioning from a non-operating mode to a heating activation mode for heating operation, the blower device (not illustrated) of an indoor unit 3 is stopped for a preconfigured amount of time, and thereafter, the flow rate is gradually increased, thereby enabling a fast start of heating operation, while also improving user comfort without causing the user to feel cold air.

[Other]

Also, it is sufficient for the first heat medium channel switching devices 32 and the second heat medium channel switching devices 33 described in the Embodiment to be devices able to switch channels, such as devices able to switch among a three-way channel such as three-way valves, or a combination of two opening and closing valves or other devices that open and close a two-way channel. In addition, devices able to vary the flow rate in a three-way channel such as a mixing valve driven by a stepping motor, or a combination of two devices able to vary the flow rate in a two-way channel such as an electronic expansion valve, may be used as the first heat medium channel switching devices 32 and the second heat medium channel switching devices 33. In this case, it is also possible to prevent a water hammer caused by the sudden opening or closing of a channel. Furthermore, although the Embodiment describes as an example the case where the heat medium flow control devices 25 are two-way valves, the heat medium flow control devices 25 may also be control valves having a three-way passage, and may be installed together with bypass pipes that bypass the use side heat exchangers 35.

Also, the heat medium flow control devices 34 may use a device driven by a stepping motor and able to control the flow rate flowing through a channel, and may also be a two-way valve or a three-way valve with one end sealed. Moreover, a device such as an opening and closing valve that opens and closes a two-way channel may be used as the heat medium flow control devices 34, with the average flow rate controlled by repeatedly switching the valve on and off.

In addition, although the second refrigerant channel switching devices 28 are illustrated like four-way valves, the configuration is not limited thereto, and refrigerant may be made to flow in the same way by using multiple two-way channel switching valves or three-way channel switching valves.

Also, a similar effect is obviously achieved even in the case where only one use side heat exchanger 35 and heat medium flow control device 34 are connected. In addition, installing multiple intermediate heat exchangers 25 and expansion devices 26 that work the same obviously poses no problems. Furthermore, although an example is described in which the heat medium flow control devices 34 are housed inside the relay unit 2, the configuration is not limited thereto, and the heat medium flow control devices 34 may also be housed inside the indoor units 3.

For the heat medium, substances such as brine (antifreeze), water, a mixture of brine and water, or a mixture of water and a highly anticorrosive additive may be used. Consequently, the air-conditioning apparatus 100 contributes to improved safety even if the heat medium leaks into the indoor space 7 via the indoor units 3, because a highly safe substance is used for the heat medium.

Although the Embodiment describes an example in which an accumulator 19 is included in the air-conditioning apparatus 100, the accumulator 19 may also not be provided. Furthermore, although blower devices are typically installed in the heat source side heat exchanger 12 and the use side heat exchangers 35 to promote condensation or evaporation by sending air, the configuration is not limited thereto. For example, a device using a panel heater or similar component utilizing radiation may also be used as the use side heat exchangers 35, while a water-cooled device that moves heat using water or antifreeze may also be used as the heat source side heat exchanger 12. In other words, any type of structure able to give off or take away heat may be used as the heat source side heat exchanger 12 and the use side heat exchangers 35.

The Embodiment describes an example in which there are four use side heat exchangers 35, but the number is not particularly limited. In addition, although the case of two intermediate heat exchangers 25*a* and 25*b* is described as an example, the configuration is obviously not limited thereto, and any number of intermediate heat exchangers may be installed insofar as the configuration enables the cooling and/or heating of heat medium. Furthermore, the pump 31*a* and the pump 31*b* are not limited to one each, and multiple low-capacity pumps may also be connected in parallel.

As above, an air-conditioning apparatus 100 according to the Embodiment not only attempts to improve safety by not circulating heat source side refrigerant all the way to the indoor units 3 or the vicinity of the indoor units 3, but also activates the blower devices of the indoor units 3 after the heat medium temperature changes to a predetermined temperature during a change of operating mode that induces a temperature change in the heat medium, such as when switching from a stopping operating mode of the indoor units 3 to a cooling operation mode or a heating operation mode, or when switching back and forth between heating only operating mode and cooling only operating mode. For this reason, it is possible to improve comfort during the startup of the indoor units 3, without sending hot air during the cooling operation mode, or cold air during the heating operation mode.

REFERENCE SIGNS LIST

1 outdoor unit, 2 relay unit, 3 indoor units, 3*a* indoor unit, 3*b* indoor unit, 3*c* indoor unit, 3*d* indoor unit, 4 refrigerant pipes, 4*a* refrigerant connecting pipe, 4*b* refrigerant connecting pipe, pipes (heat medium transport pipes), 6 outdoor space, 7 indoor space, 8 space, 9 facility, 10 compressor, 11 first refrigerant channel switching device, 12 heat source side heat exchanger, 13*a* check valve, 13*b* check valve, 13*c* check valve, 13*d* check valve, 19 accumulator, 20 bypass pipe, 25 intermediate heat exchangers, 25*a* intermediate heat exchanger, 25*b* intermediate heat exchanger, 26 expansion devices, 26*a* expansion device, 26*b* expansion device, 27 opening and closing device, 28 second refrigerant channel switching devices, 28*a* second refrigerant channel switching device, 28*b* second refrigerant channel switching device, 29 opening and closing device, 31 pumps, 31*a* pump, 31*b* pump, 32 first heat medium channel switching devices, 32*a* first heat medium channel switching device, 32*b* first heat medium channel switching device, 32*c* first heat medium channel switching device, 32*d* first heat medium channel switching device, 33 second heat medium channel switching devices, 33*a* second heat medium channel switching device, 33*b* second heat medium channel switching device, 33*c* second heat medium channel switching device, 33*d* second heat medium channel switching device, 34 heat medium flow control devices, 34*a* heat medium flow control device, 34*b* heat medium flow control device, 34*c* heat medium flow control device, 34*d* heat medium flow control device, 35 use side heat exchangers, 35*a* use side heat exchanger, 35*b* use side heat exchanger, 35*c* use side heat exchanger, 35*d* use side heat exchanger, 36 use side heat exchanger, 40 temperature sensors, 40*a* temperature sensor, 40*b* temperature sensor, 50 control device, 100 air-conditioning apparatus, A refrigerant circuit, B heat medium circuit

The invention claimed is:

1. An air-conditioning apparatus, comprising:

a refrigerant circuit that circulates heat source side refrigerant through a compressor, a heat source side heat exchanger, a plurality of expansion devices, and refrigerant side flow channels of a plurality of intermediate heat exchangers, which are connected by refrigerant pipes;

a heat medium circuit that circulates heat medium through a pump, a plurality of use side heat exchangers, and heat medium side flow channels of the plurality of intermediate heat exchangers, which are connected by heat medium transport pipes;

a temperature sensor configured to detect a temperature of the heat medium; and a blower device corresponding to each of the use side heat exchangers, wherein the air-conditioning apparatus exchanges heat between the heat source side refrigerant and the heat medium in the intermediate heat exchangers, and includes a cooling operation mode in which at least one of the plurality of use side heat exchangers performs cooling operation using heat medium cooled by the intermediate heat exchangers, a heating operation mode in which at least one of the plurality of use side heat exchangers performs heating operation using heat medium heated by the intermediate heat exchangers, and a non-operating mode in which the compressor, the pump, each of the use side heat exchangers, and each of the blower devices are stopped, when starting the cooling operation mode from the non-operating mode, the blower device of an indoor unit from which a start command is originated is operated, when starting the heating operation mode from the non-operating mode, the heat medium is flowed to the use side heat exchangers from the intermediate heat exchangers while the blower device of the indoor unit from which a start command is originated is not operated, after a preset time has elapsed from when the heat medium is first flowed to the use side heat exchangers from the intermediate heat exchangers, the blower device of the indoor unit from which the start command is originated is operated such that a volume of air blown by the blower device is increased in a stepwise manner from a first flow rate to a second flow rate, and when the temperature sensor determines that the temperature of the heat medium has reached a preset temperature, the blower device of the indoor unit from which a start command is originated is operated such that the volume of air blown by the blower device is increased to a third flow rate, and the first flow rate is less than the second flow rate, the second flow rate is less than the third flow rate.

2. The air-conditioning apparatus of claim 1, comprising:

a heat medium channel switching device that switches a supply of heat medium to any of the use side heat exchangers from any of the intermediate heat exchangers; and a heat medium flow control device that regulates a flow rate of heat medium supplied to the use side heat exchangers from the intermediate heat exchanger, wherein when the operating mode changes from the non-operating mode to the cooling operation mode, or when the operating mode changes from the non-operating mode to the heating operation mode, the heat medium channel switching device and the heat medium flow control device are operated to ensure a flow channel of the heat medium circuit.

3. The air-conditioning apparatus of claim 2, wherein the heat medium channel switching device and the heat medium flow control device are operated to ensure a flow channel of the heat medium circuit before operating the pump.

4. The air-conditioning apparatus of claim 1, wherein the heat source side refrigerant is any of a single component refrigerant, a near-azeotropic refrigerant mixture, a non-azeotropic refrigerant mixture, a refrigerant that undergoes two-phase change, including natural refrigerants, and a refrigerant that goes supercritical.

5. The air-conditioning apparatus of claim 1, wherein the heat medium is any of water, antifreeze, a mixture of water and antifreeze, and a mixture of water, antifreeze, or a mixture of water and antifreeze with an anticorrosive additive.

6. The air-conditioning apparatus of claim 1, wherein the preset temperature is an indoor temperature where the indoor unit is provided.

* * * * *